US012507853B2

(12) United States Patent
Moser et al.

(10) Patent No.: US 12,507,853 B2
(45) Date of Patent: Dec. 30, 2025

(54) FLOOR CLEANING MACHINE WITH HAIR PICKUP AND METHOD FOR OPERATING A FLOOR CLEANING MACHINE

(71) Applicant: Alfred Kärcher SE & Co. KG, Winnenden (DE)

(72) Inventors: Fabian Moser, Winnenden (DE); Michael Scharmacher, Winnenden (DE); Simon Kirschbaum, Winnenden (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 122 days.

(21) Appl. No.: 17/687,289

(22) Filed: Mar. 4, 2022

(65) Prior Publication Data

US 2022/0225852 A1 Jul. 21, 2022

Related U.S. Application Data

(63) Continuation of application No. PCT/EP2019/073890, filed on Sep. 6, 2019.

(51) Int. Cl.
*A47L 11/40* (2006.01)
*A47L 11/292* (2006.01)

(52) U.S. Cl.
CPC ..... *A47L 11/4041* (2013.01); *A47L 11/292* (2013.01); *A47L 11/4016* (2013.01); *A47L 11/4069* (2013.01); *A47L 11/4075* (2013.01); *A47L 11/4083* (2013.01); *A47L 2201/04* (2013.01)

(58) Field of Classification Search
None
See application file for complete search history.

(56) References Cited

U.S. PATENT DOCUMENTS

| | | | |
|---|---|---|---|
| 541,495 | A | 6/1895 | Paris |
| 10,212,895 | B2 | 2/2019 | Owegeser |
| 2002/0148056 | A1 | 10/2002 | Morokutti |
| 2016/0270620 | A1 | 9/2016 | Miller et al. |
| 2017/0215676 | A1 | 8/2017 | Moser et al. |
| 2017/0215677 | A1 | 8/2017 | Moser et al. |
| 2017/0215678 | A1 | 8/2017 | Moser et al. |
| 2017/0215679 | A1 | 8/2017 | Moser et al. |
| 2017/0215681 | A1 | 8/2017 | Moser et al. |
| 2017/0258011 | A1 | 9/2017 | Owegeser |
| 2018/0206685 | A1 | 7/2018 | Li et al. |

(Continued)

FOREIGN PATENT DOCUMENTS

| | | |
|---|---|---|
| CN | 2868167 | 2/2007 |
| CN | 109044210 | 12/2018 |

(Continued)

*Primary Examiner* — Kaj K Olsen
*Assistant Examiner* — Pradhuman Parihar
(74) *Attorney, Agent, or Firm* — Womble Bond Dickinson (US) LLP

(57) ABSTRACT

A floor cleaning machine is provided, including a floor head, and at least one cleaning roller, which is arranged on the floor head and rotates about an axis of rotation in a cleaning operation, wherein the at least one cleaning roller has a textile covering, wherein arranged on the floor head is at least one pin strip with a plurality of pins for picking up hair, and wherein the pins abut against the textile covering or penetrate into the textile covering.

26 Claims, 17 Drawing Sheets

(56) References Cited

U.S. PATENT DOCUMENTS

| | | | |
|---|---|---|---|
| 2018/0228331 | A1 | 8/2018 | Moser et al. |
| 2019/0000292 | A1* | 1/2019 | Rufenach ..... A47L 11/292 |
| 2019/0069748 | A1* | 3/2019 | Blumhardt ..... A47L 11/4019 |
| 2019/0125155 | A1 | 5/2019 | Lindenbeck |
| 2020/0170472 | A1 | 6/2020 | Meisenbacher et al. |

FOREIGN PATENT DOCUMENTS

| | | |
|---|---|---|
| CN | 109199228 | 1/2019 |
| DE | 295 13 474 | 10/1995 |
| DE | 20 2016 105 296 | 10/2016 |
| WO | WO 2010/041184 | 4/2010 |
| WO | WO 2014/095614 | 6/2014 |
| WO | WO 2018/162091 | 9/2018 |

* cited by examiner

FLOOR CLEANING MACHINE WITH HAIR PICKUP AND METHOD FOR OPERATING A FLOOR CLEANING MACHINE

CROSS-REFERENCE TO RELATED APPLICATIONS

This application is a continuation of international application number PCT/EP2019/073890, filed on Sep. 6, 2019, which is incorporated herein by reference in its entirety and for all purposes.

BACKGROUND OF THE INVENTION

The invention relates to a floor cleaning machine, comprising a floor head, and at least one cleaning roller, which is arranged on the floor head and rotates about an axis of rotation in a cleaning operation, wherein the at least one cleaning roller has a textile covering.

The invention further relates to a method for operating a floor cleaning machine in which a cleaning roller is arranged on a floor head and the cleaning roller rotates in a cleaning operation.

Surface cleaning machines are disclosed in WO 2016/058901 A1, WO 2016/058856 A1, WO 2017/063663 A1, WO 2016/058879 A1, and WO 2016/058956 A1 as well as WO 2016/058907 A1.

DE 20 2016 105 296 U1 discloses a floor cleaning apparatus with a cleaning mechanism for a cleaning drum.

WO 2018/001754 A1 discloses a wet appliance with a rotatable cleaning roller and a displaceable scraping device.

WO 2018/162091 A1 discloses a self-propelled and self-steering floor cleaning appliance.

WO 2017/152973 A1 discloses a surface cleaning machine with a suction fan-free coupling of dirty liquid into a dirty fluid tank device.

US 2018/0206685 A1 discloses a cleaning mechanism for a cleaning roller.

US 2016/0270620 A1 discloses a multifunctional cleaning tool.

US 2002/0148056 A1 discloses a floor cleaning machine with a rotating brush.

In accordance with an embodiment of the invention, a floor cleaning machine of the kind stated at the outset is provided, with which an optimized cleaning result can be achieved.

SUMMARY OF THE INVENTION

In accordance with an embodiment of the invention, the floor cleaning machine stated at the outset is provided, wherein arranged on the floor head is at least one pin strip with a plurality of pins for picking up hair and wherein the pins abut against the textile covering or penetrate into the covering.

It has been shown that an effective hair pickup is achieved by the use of the at least one pin strip with pins. Hair is wound up, in a sense, on the pins in the manner of a hairbrush. A floor subjected to hair contamination can thus be effectively cleaned.

It has been shown that it is favorable if the pins are project into the textile covering with a penetration depth in the range between 0 mm and 4 mm. Here, a penetration depth of 0 mm means that a corresponding pin abuts against the textile covering. If the pins do not contact the textile covering or do not penetrate far enough, then a good hair pickup is not achieved. If the pins penetrate too deep, then this results in an increased current consumption of the floor cleaning machine and an unnecessary increased load on the motor and on the transmission.

It is favorable if the pins have a flat face side, which has a diameter in the range between 0.1 mm and 0.5 mm, wherein, in particular, the diameter is about 0.3 mm. This results in an effective cleaning result. Damage to the textile covering as a result of the pins can be avoided because they are not "pointed" enough.

For an optimized cleaning result, it is favorable if pins in at least one row are arranged on the pin strip, wherein the at least one row has a longitudinal direction. The pins are arranged at a distance from one another in the row. An optimized hair pickup can thus be achieved. Hair is wound up, in a sense, on the pins in the manner of a hairbrush.

It is favorable if the longitudinal direction is at least approximately parallel to an axis of rotation of the at least one cleaning roller. This results in an optimized cleaning result with optimized hair pickup while having a constructively simple structure.

An optimized hair pickup is achieved if a plurality of rows are provided, wherein rows are spaced apart in a transverse direction and the transverse direction is oriented transversely to the longitudinal direction. A "wrapping up of hair" on the pins can thus be effectively achieved.

It is favorable if the at least one pin strip is positioned on the floor head so as to be releasable by a user. The pin strip can then be removed by a user without great effort in order to clean same (in order to remove hair that is wound up thereon).

It is favorable if a scraping device with at least one scraper for scraping dirty liquid from the at least one cleaning roller is provided. Dirty liquid can thereby be removed from the at least one cleaning roller and fed to a tank device for dirty fluid.

An effective removal of dirty liquid from the at least one cleaning roller is achieved when the at least one scraper penetrates into the textile covering. Reference is made in this regard to WO 2015/086083 A1, which is expressly referred to.

It has proven to be advantageous if the pins project into the textile covering to an equal or lesser extent than the at least one scraper and, in particular, if a difference between a penetration depth of the scraper and a penetration depth of the pins is in the range between 0 mm and 1 mm inclusively. The scraper can be effectively used to remove dirty liquid and the pins can be effectively used to "filter out" hair.

It is particularly advantageous if the at least one pin strip is arranged downstream from the at least one scraper in relation to a direction of rotation of the at least one cleaning roller, and, in particular, if the at least one scraper is arranged downstream from a sweeping element in relation to the direction of rotation. The sweeping element then firstly has the function of gathering coarse dirt and providing it to the at least one cleaning roller to be taken up by same. Dirty liquid can subsequently be scrapped off on the scraper and then fed to the tank device for dirty liquid. Hair that is then still found on the at least one cleaning roller after the scraper can be picked up by the at least one pin strip and be "filtered out". This results in an optimized cleaning result overall.

The pins and, in particular, all pins are aligned in a pin direction, with at least one of the following:

- the pins are of straight configuration;
- the pin direction is oriented transversely and, in particular, perpendicularly to the axis of rotation of the at least one cleaning roller;

the pin direction is oriented in parallel or obliquely to a z-direction in which a tank device is movably mounted on the floor head in a cleaning operation;

the pin direction is oriented perpendicularly or obliquely to a contact plane of the at least one cleaning roller for the floor to be cleaned;

the pin direction is in an angular range between 0° and 25° to a motion axis of the at least one pin strip;

the pin direction is parallel or at an acute angle to a scraper and/or an opening wall for the at least one cleaning roller.

It has been shown that this then results in an optimized cleaning result.

It is particularly advantageous if the at least one pin strip is movably and, in particular, displaceably mounted on the floor head. The at least one pin strip can then be brought into such a position that results in an optimized cleaning result. This position is hereby independent of the concrete configuration of the at least one cleaning roller, such that, for example, manufacturing tolerances and wear as well as different roller diameters have no influence on the action of the pins on the textile covering, such that the pins either abut against the textile covering or penetrate into the textile covering with a defined penetration depth.

The object stated at the outset is further accomplished in accordance with the invention in that a holder is movable and, in particular, is displaceably mounted on the floor head, with at least one of the following:

at least one pin strip with a plurality of pins is arranged on the holder, wherein the pins abut against or penetrate into the textile covering of the at least one cleaning roller;

at least one scraper of a scraping device is arranged on the holder, wherein the at least one scraper penetrates into the textile covering.

In a sense, the at least one pin strip and/or the scraper can be advanced and preferably automatically advanced to the at least one cleaning roller by way of the holder. The relative position between pins and/or scraper on the textile covering of the at least one cleaning roller is then set in a desired manner, independently of the concrete configuration of the cleaning roller.

Manufacturing tolerances can lead to different diameters of cleaning rollers. The diameter can change as a result of wear to the textile covering. Due to the advanceability of the holder, the same position of the pins of the pin strip and/or of the scraper on the at least one cleaning roller and thereby in relation to the textile covering can always be achieved independently of said diameter variations. This results in an optimized cleaning result. Further, an energy-saving operation of the at least one cleaning roller can be achieved, because the pins and/or the scraper do not have to penetrate in any further than is necessary for an optimized cleaning result.

In one embodiment, an input-coupling element for dirty fluid into the tank device is arranged on the holder (or the input-coupling element is said holder), in particular with at least one of the following:

the at least one scraper is arranged on the input-coupling element;

at least one opening for coupling dirty fluid into a tank device (for dirty fluid) is arranged completely or partially on the input-coupling element;

the at least one scraper forms an opening wall;

the at least one pin strip sits on the input-coupling element;

the at least one pin strip is removable from the input-coupling element for a user and/or the input-coupling element is removable from the floor head for a user.

In particular, the input-coupling element can be used to hold both the at least one pin strip and the scraper. A movable and, in particular, displaceable arrangement of the input-coupling element results in a simple constructive design.

In particular, a motion axis for the at least one pin strip or the holder is provided with at least one of the following:

the motion axis is oriented transversely and, in particular, perpendicularly to the axis of rotation;

the motion axis is oriented perpendicularly or obliquely to a contact plane of the at least one cleaning roller for a floor to be cleaned;

the motion axis is oriented in parallel or obliquely to a z-axis in which a tank device, which sits on the floor head, is movable;

the motion axis is aligned to the axis of rotation (of the at least one cleaning axis).

Thus, an optimized positioning of pins of the at least one pin strip and/or of the at least one scraper relative to the at least one cleaning axis can be achieved.

In particular, the at least one pin strip or the holder is movable relative to a tank device, which is arranged on the floor head. The tank device may hereby be fixedly arranged on the floor head, or it itself may be movably arranged on the floor head.

It is particularly advantageous if the at least one pin strip or the holder is force-driven in the direction of the at least one cleaning roller and, in particular, is pressed against the at least one cleaning roller. A position of the at least one pin strip and/or of the scraper that is optimized for a cleaning can thus be achieved.

For example, a spring device is provided for the at least one pin strip or the holder, which accordingly provides a spring force for force-driven positioning. Alternatively or in addition, it is possible that the at least one pin strip or the holder are gravity-driven, i.e., that gravity ensures an appropriate positioning.

It is particularly advantageous if the at least one pin strip and/or the holder have an abutment surface for the at least one cleaning roller (and thereby in particular for a surface of the at least one cleaning roller), wherein, in particular, the pins and/or the at least one scraper protrude from the abutment surface. A contact element for the at least one cleaning roller can thereby be provided, which by striking against the surface of the at least one cleaning roller ensures an optimized positioning of the pins and/or the scraper.

In one embodiment, the at least one cleaning roller is of two-part configuration and a center drive is provided. A cleaning close to edges can thereby be achieved.

In one embodiment, a tank device, in particular for dirty fluid, is arranged on the floor head and, in particular, dirty liquid that is removed from the at least one cleaning roller is fed to the tank device in a blower-free manner, wherein, in particular, the tank device is mounted for oscillation on the floor head, and one or more sweeping elements are arranged on the tank device. This results in a compact configuration. It is also possible in principle that a tank device for dirty fluid is arranged, e.g., on a holding rod device.

It is particularly advantageous if a tank device for cleaning liquid and a supply device for cleaning liquid to the at least one cleaning roller and/or to a floor to be cleaned is provided. A wet wiping of a floor to be cleaned can thereby be performed. Dirt can be loosed by the floor and the cleaning roller being moistened. The dirt can be removed and picked up by way of the mechanical contact of the textile covering of the at least one cleaning roller with the floor. The cleaning liquid is fresh water or a mixture of fresh water and, in particular, surfactant cleaning agent.

It is particularly advantageous if a sweeping element is associated with the at least one cleaning roller, and the at least one sweeping element is arranged upstream from a scraper for the at least one cleaning roller in relation to a normal direction of rotation of the at least one cleaning roller in a cleaning operation. Coarse dirt can be gathered and provided to the cleaning roller by way of the sweeping element, dirty fluid including coarse dirt then being removable from the at least one cleaning roller by way of the scraper.

In one embodiment, a first cleaning roller and a second cleaning roller are provided, wherein the second cleaning roller is arranged on the floor head at a distance from the first cleaning roller, in particular with at least one of the following:

- a first axis of rotation of the first cleaning roller and a second axis of rotation of the second cleaning roller are oriented in parallel to one another;
- in a normal operating mode of the floor cleaning machine, the first cleaning roller and the second cleaning roller rotate in opposite directions;
- a tank device for dirty fluid is arranged on the floor head;
- the tank device for dirty fluid is positioned between the first cleaning roller and the second cleaning roller;
- a blower-free coupling of dirty fluid from the first cleaning roller and the second cleaning roller into the tank device is provided;
- a first sweeping element is associated with the first cleaning roller and/or a second sweeping element is associated with the second cleaning roller.

This results in an optimized cleaning result. In this respect, reference is made, as an example, to WO 2019/048496 A1 or the not previously published DE 10 2019 109 946.

In an alternative embodiment, one single cleaning roller is arranged on the floor head and, in particular, the floor head is supported on a floor to be cleaned only by way of the cleaning roller. This results in a compact structure. In this respect, reference is made, as an example, to WO 2015/086083 A1 or WO 2016/058879 A1.

In one embodiment, a holding device is provided for a user, which is arranged and, in particular, is pivotably arranged on the floor head, wherein the floor cleaning machine, in particular, is of hand-held or hand-guided configuration, and wherein same, in particular, is operable by a user in a standing position. A floor cleaning can thus be performed in a simple manner.

It is also possible that the floor cleaning machine is of self-propelled and self-steering configuration and thereby is configured, in particular, as a cleaning robot and preferably as a wiping robot.

The object stated at the outset is achieved in accordance with the invention in the method stated at the outset in that a pin strip with a plurality of pins and/or a scraper is movably mounted and, in particular, displaceably mounted on the floor head and is pressed under the application of force against the at least one cleaning roller.

A defined positioning of pins and/or the scraper on the at least one cleaning roller can thereby be achieved independently of the diameter of the at least one cleaning roller.

The method in accordance with the invention has the advantages that have already been explained in the context of the apparatus in accordance with the invention.

In particular, the method in accordance with the invention can be performed on the floor cleaning machine in accordance with the invention or the floor cleaning machine can be operated with the method in accordance with the invention.

In particular, an abutment element is pressed against the cleaning roller (and thereby preferably pressed against a surface of the cleaning roller), and abuts with an abutment surface thereagainst, wherein, in particular, pins of the pin strip and/or the scraper project over the abutment element and abut against or penetrate into a textile covering of the at least one cleaning roller. This results in an optimized cleaning result.

The subsequent description of preferred embodiments serves in conjunction with the drawings for further explanation of the invention.

DETAILED DESCRIPTION OF THE INVENTION

Figure 1:
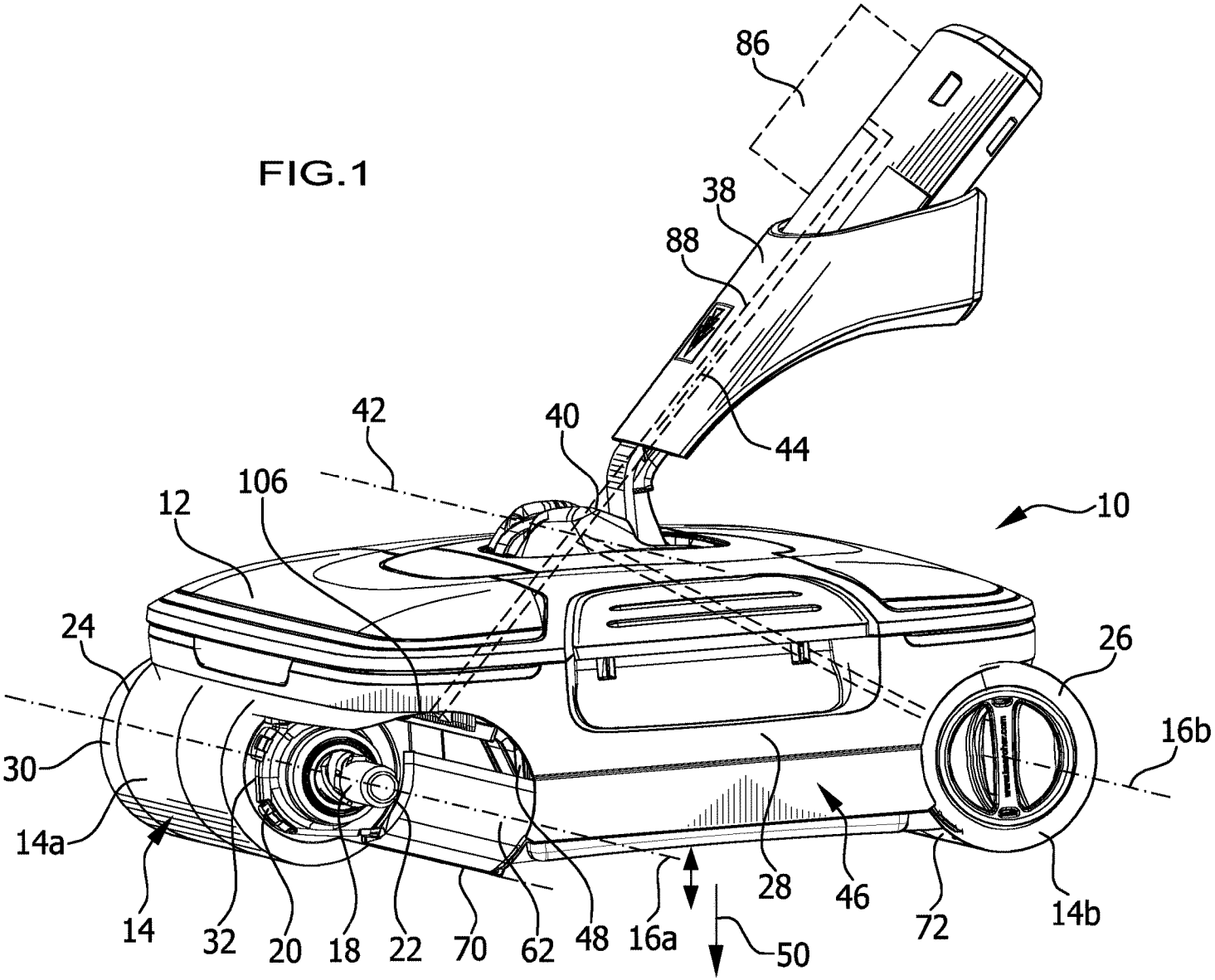
FIG. 1 shows a partial depiction of an embodiment of a floor cleaning machine in accordance with the invention, wherein a holding (rod) device is shown in a partial depiction and only one part of a two-part (front) cleaning roller is shown.
Figure 2:
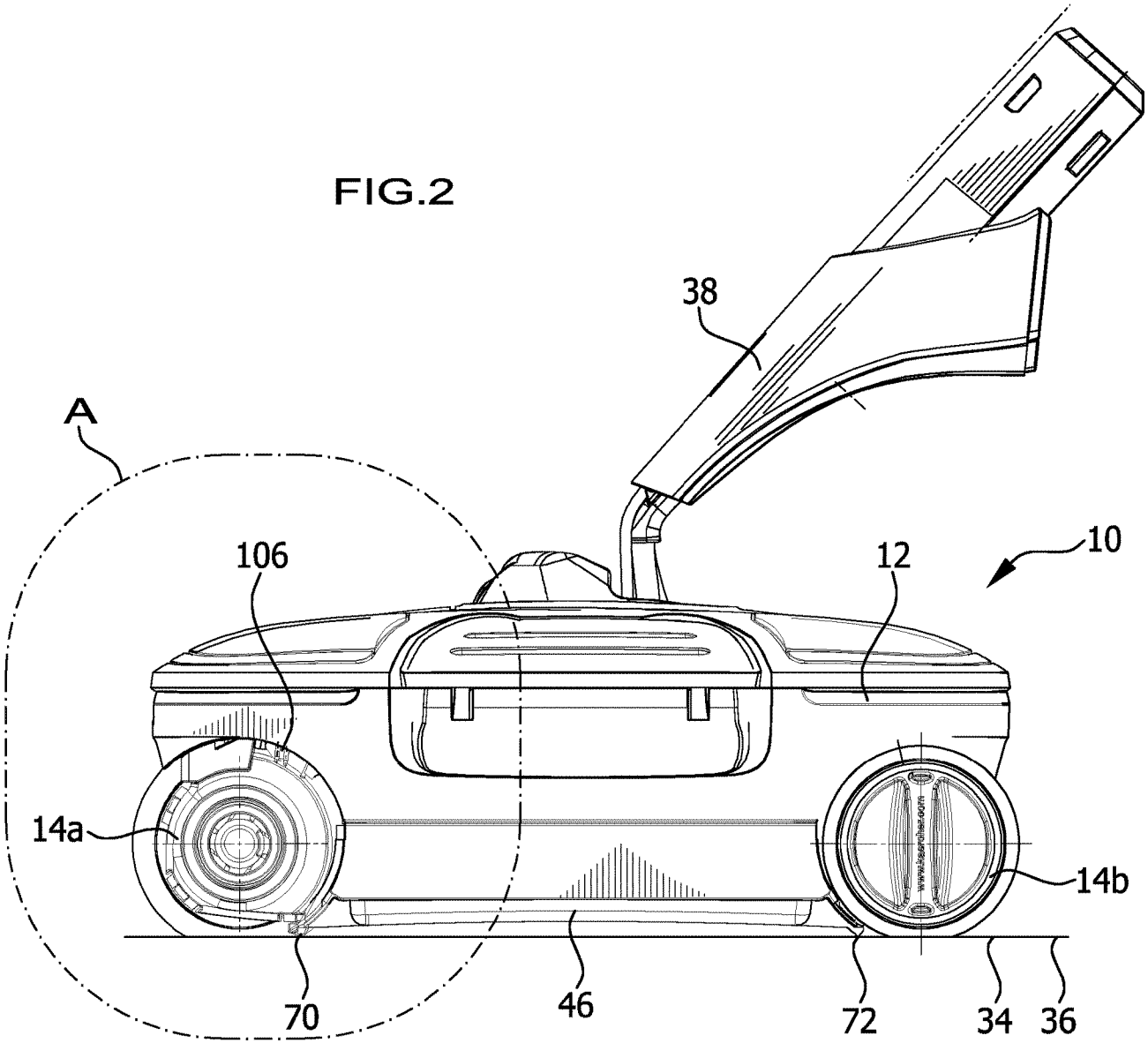
FIG. 2 shows a side view of the floor cleaning machine in accordance with FIG. 1.

An embodiment of a floor cleaning machine in accordance with the invention, which is shown in FIGS. 1 and 2 in a partial depiction and is denoted by 10, is configured as a hand-held and hand-guided floor cleaning machine, which is operable by a user in a standing position.

The floor cleaning machine 10 comprises a floor head 12. At least one cleaning roller 14 is arranged on the floor head 12. In the embodiment shown, a first cleaning roller 14*a* and a second cleaning roller 14*b* are rotatably mounted on the floor head 12. The first cleaning roller 14*a* and the second cleaning roller 14*b* are spaced at a distance and are hereby oriented in parallel to one another.

The first cleaning roller 14*a* is rotatable about a first axis of rotation 16*a*. The second cleaning roller 14*b* is rotatable about a second axis of rotation 16*b*. The first axis of rotation 16*a* and the second axis of rotation 16*b* are in parallel to one another.

A first shaft 18 is arranged on the floor head 12 for the first cleaning roller 14*a*. A second shaft (not visible in the drawings) is associated with the second cleaning roller 14*b*. The first shaft 18 and the second shaft are each connected to a drive motor by way of a transmission device. Said drive motor sits, in particular, on the floor head 12.

Provision is hereby made that at least for a normal operating mode of the floor cleaning machine 10, the first cleaning roller 14*a* and the second cleaning roller 14*b* are operated in opposite directions and, in particular, at the same rotational speed.

Regarding further embodiments for the drive motor and the transmission device, reference is made to the not previously published German patent application Nr. 10 2019 109 946.3 of 15 Apr. 2019 from the same applicant. Express reference is made to this document in its entirety.

In one embodiment, the first cleaning roller 14*a* and the second cleaning roller 14*b* are each of two-part configuration. The first shaft 18 comprises a first shaft region 20 and a second shaft region 22. The respective first part like, for example, the first part 24 of the first cleaning roller 14*a* sits on the first shaft region 20. The second part of the first cleaning roller 14*a* is not shown in FIGS. 1 and 2. There, the second part 26 of the second cleaning roller 14*b* is visible. A center drive is provided for the rotational drive of the first cleaning roller 14*a* and the second cleaning roller 14*b*. A torque-effective coupling of the drive motor to the cleaning rollers 14*a* and 14*b* takes place in a middle region between outer ends. In particular, the first cleaning roller 14*a* and the second cleaning roller 14*b* extend up to a side rim 28 of the floor head 12. A cleaning close to edges is thereby possible.

In this respect, reference is made, as an example, to DE 10 2019 109 946.

In one embodiment, a cleaning roller 14 comprises a textile covering 30, which is arranged on a corresponding cylindrical holder 32.

In a cleaning operation of the floor cleaning machine 10, the floor head 12 is supported on a floor 34 to be cleaned (FIG. 2) by way of the first cleaning roller 14*a* and the second cleaning roller 14*b*. The floor head 12 with its cleaning rollers 14*a*, 14*b* has a contact plane 36 for the floor 34. The floor 34 to be cleaned is, in particular, a hard floor.

The floor cleaning machine 10 comprises a holding device 38. Said holding device is configured, in particular, as a holding rod device (of which only part is shown in FIGS. 1 and 2). The holding device 38 is pivotably articulated on the floor head 12 by way of a pivot joint 40. A pivot axis 42 of the pivotability of the holding device 38 in relation to the floor head 12 is oriented, in particular, in parallel to the first axis of rotation 16*a* or the second axis of rotation 16*b*.

A further pivotability about a pivot axis 44 may also be present, which is locked transversely to the pivot axis 42. The pivot axis 42 is thereby, in particular, in parallel to the contact plane 36.

The floor cleaning machine 10 is hand-guided. The holding device 38 is configured such that a user can guide the floor cleaning machine 10 over the floor 34 to be cleaned, wherein the floor head 12 is supported on the floor 34 by way of the cleaning rollers 14*a*, 14*b*, and the user themselves is standing on the floor 34 at a distance from the floor head 12; the hand-guided floor cleaning machine 10 is configured, in particular, such that it is operable by a user in a standing position. In this respect, reference is made to DE 10 2019 109 946.

A tank device 46 is releasably arranged on the floor head 12. The tank device 46 is releasably positioned on a tank device holder 48 of the floor head 12. The tank device 46 is releasable downwardly from the floor head 12 in a removal direction 50 (FIG. 1). The removal direction 50 is oriented, in particular, perpendicularly to the contact plane 36.

The tank device 46 is positioned on the holder 48 between the first cleaning roller 14*a* and the second cleaning roller 14*b*. The tank device 46 serves to accommodate dirty fluid, which is "removed" from the cleaning rollers 14*a*, 14*b* and fed to the tank device 46. In the embodiment shown, one single tank device 46 is provided for the first cleaning roller 14*a* and the second cleaning roller 14*b*.

It is also possible in principle that the first cleaning roller 14*a* and the second cleaning roller 14*b* are each associated with their own respective tank, such that the tank device comprises two separate or connected parts.

The tank device 46 is arranged, in particular, such that dirty fluid from the cleaning rollers 14 is directly coupleable in a blower-free manner (without suction). This is explained in more detail below.

Figure 5:
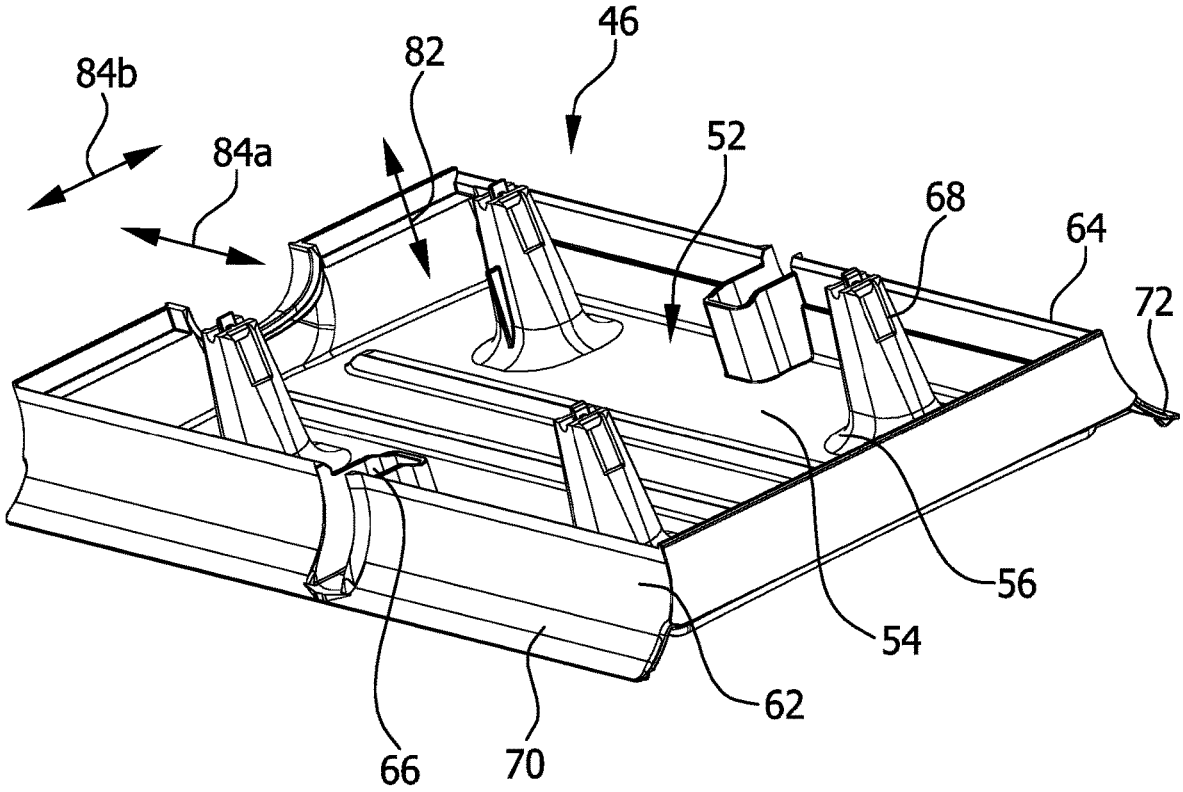
FIG. 5 shows an embodiment of a tank device or a partial region of a tank device in a perspective depiction.
Figure 6:
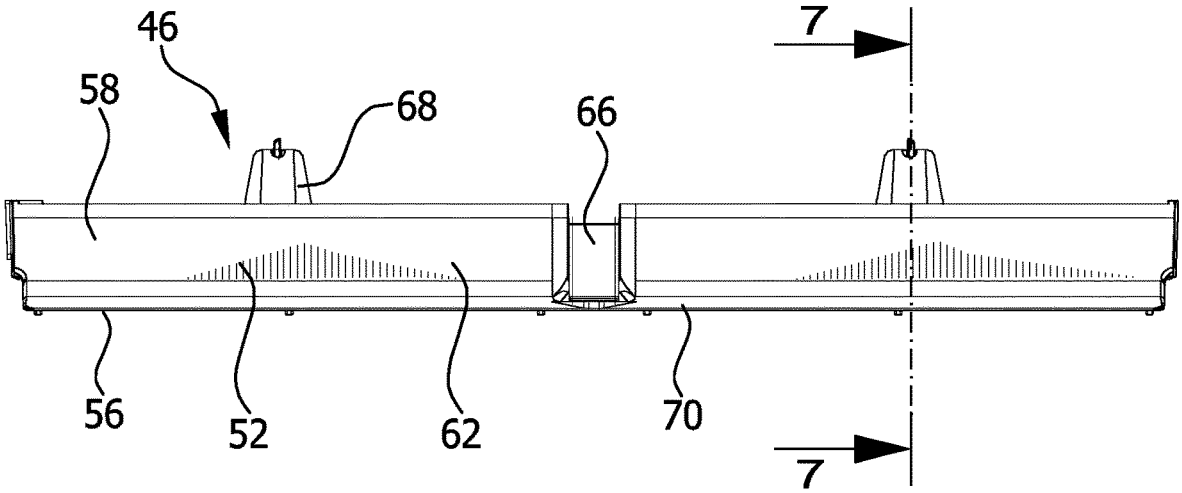
FIG. 6 shows a side view of the tank device or the partial region according to FIG. 5.

The tank device 46 (cf. FIGS. 5 to 7) comprises a tray 52 with (at least) one receiving space 54 for dirty fluid. The tray 52 has a base 56 on which a peripheral wall 58 is arranged. The receiving space 54 is formed between the base 56 and the wall 58.

In one embodiment, the tray 52 has an at least approximately cuboidal outer form.

The tank device 46 comprises a lid 60. The lid 60 (FIG. 7) may be an element that is separate from the floor head 12. In particular, the tank device 46 is then removable with the lid 62 from the tank device holder 48.

In an alternative embodiment, the lid of the tank device 46 is formed on the floor head 12, for example by the tank device holder 48. In this embodiment, only the tray 52 is removable from the floor head 12 and the corresponding lid remains on the floor head 12.

During a cleaning operation of the floor cleaning machine 10, an underside 56 of the base 56 of the tank device 46 faces toward the floor 34 to be cleaned. A first side wall 62 of the wall 58 faces toward the first cleaning roller 14*a*, and a second side wall 64 opposite the first side wall 62 of the wall 58 faces toward the second cleaning roller 14*b*.

In one embodiment, the first side wall 62 and the second side wall 64 each have a recess 66, which serves to partially accommodate the transmission device, by way of which the corresponding shaft (like, for example, the first shaft 18) is torque-effectively coupled to the drive motor. The recess 66 is arranged in the middle on the corresponding side wall 62, 64. In one embodiment, fixing elements 68 are arranged on the tray 52. They are, in particular, of dome-shaped configuration. The fixing elements 68 serve to fix the tank device 46 by way of the tray 52 on the tank device holder 48

Figure 7:
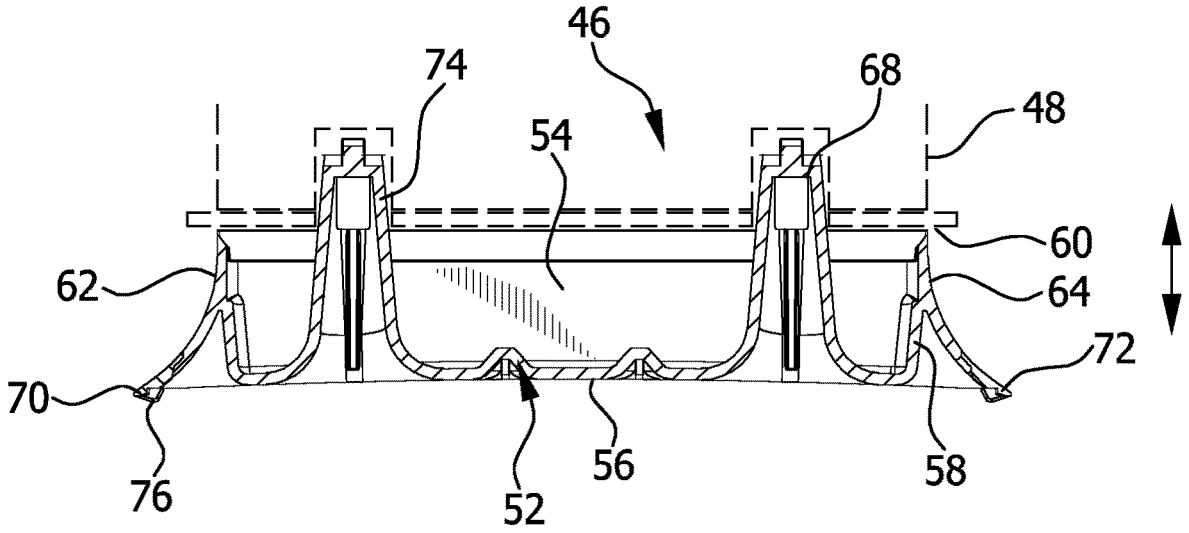
FIG. 7 shows a cut view along line 7-7 according to FIG. 6.

(cf. FIG. 7) and, in particular, to hangingly fix and thereby floatingly mount the tray 52 on the floor head 12 (cf. FIG. 7). This is explained in more detail below.

The fixing elements 68 also serve, in particular, to center and optionally additionally fix the lid 60 on the tray 52 if such a separate lid 60 is provided. The lid 60 then has corresponding recesses 74 (FIG. 7) through which the fixing elements 68 are passed.

Arranged on the floor head 12 is a first sweeping element 70, which is associated with the first cleaning roller 14*a*. Further, arranged on the floor head 12 is a second sweeping element 72, which is associated with the second cleaning roller 14*b*. The sweeping elements 70, 72 serve to gather dirt particles (in particular coarse dirt particles) and feed same to the respective associated cleaning roller 14*a* and 14*b*. These dirt particles can then be entrained by the cleaning roller 14*a* or 14*b* and be coupled into the tank device 46.

The first sweeping element 70 and the second sweeping element 72 each have a sweeping edge 76. The sweeping edge 76 is adjacent to the textile covering 30 of the corresponding cleaning roller 14 and can abut against or penetrate into it. Reference is made in this regard to WO 2016/058956 A1, which is expressly referred to.

The respective sweeping element 70, 72 with its sweeping edge 76 extends, in particular, at least approximately over the entire length of the associated cleaning roller 14. The sweeping edge 76 is aligned in parallel to the corresponding axis of rotation 16*a*, 16*b*.

The first sweeping element 70 is arranged on the first side wall 62 at a distance from the base 56 of the tray 52. Correspondingly, the second sweeping element 72 is arranged on the second side wall 64 at a distance from the base 56.

It is possible that the respective sweeping element 70, 72 is made of a rigid material or has a certain inherent elasticity.

The sweeping elements 70, 72 have, in particular, a contour facing toward the respective cleaning roller 14*a*, 14*b*, said contour being adapted to the cleaning roller 14*a*, 14*b*.

The first sweeping element 70 and the second sweeping element 72 are arranged on the tray 52 and thereby on the respective side wall 62 and 64 (front and rear side wall).

It is also possible in principle that the first sweeping element 70 and/or the second sweeping element 72 is arranged on the base 56 with the tray 52 being appropriately configured.

The first sweeping element 70 and the second sweeping element 72 are each fixedly connected to the tray 52, such that they are removable with the tray 52 from the floor head 12 and are also moved in a movability of the tray 52 relative to the floor head.

Figure 3:
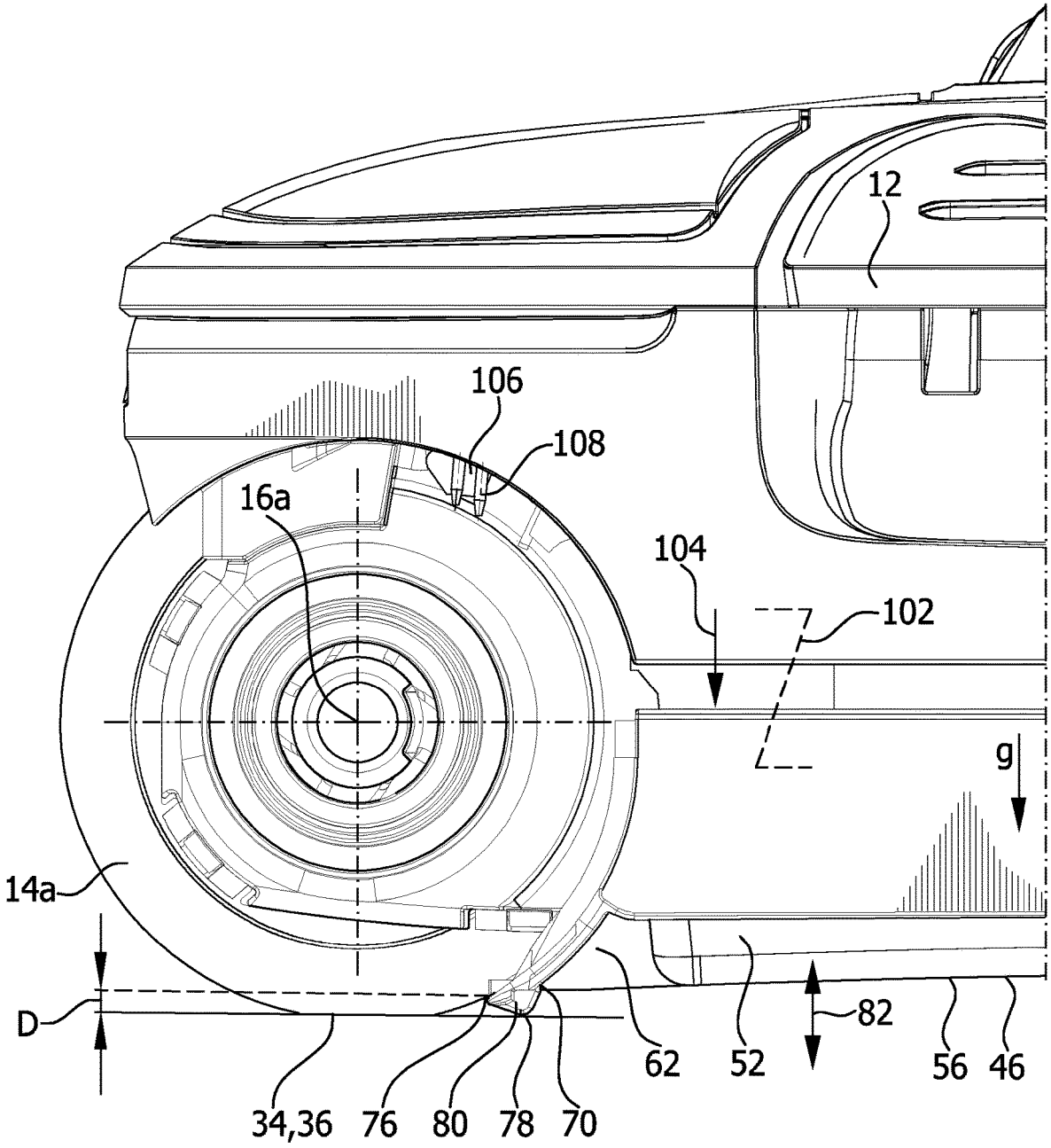
FIG. 3 shows an enlarged depiction of the region A according to FIG. 2 in the moment of the cleaning roller being placed on a floor to be cleaned.
Figure 4:
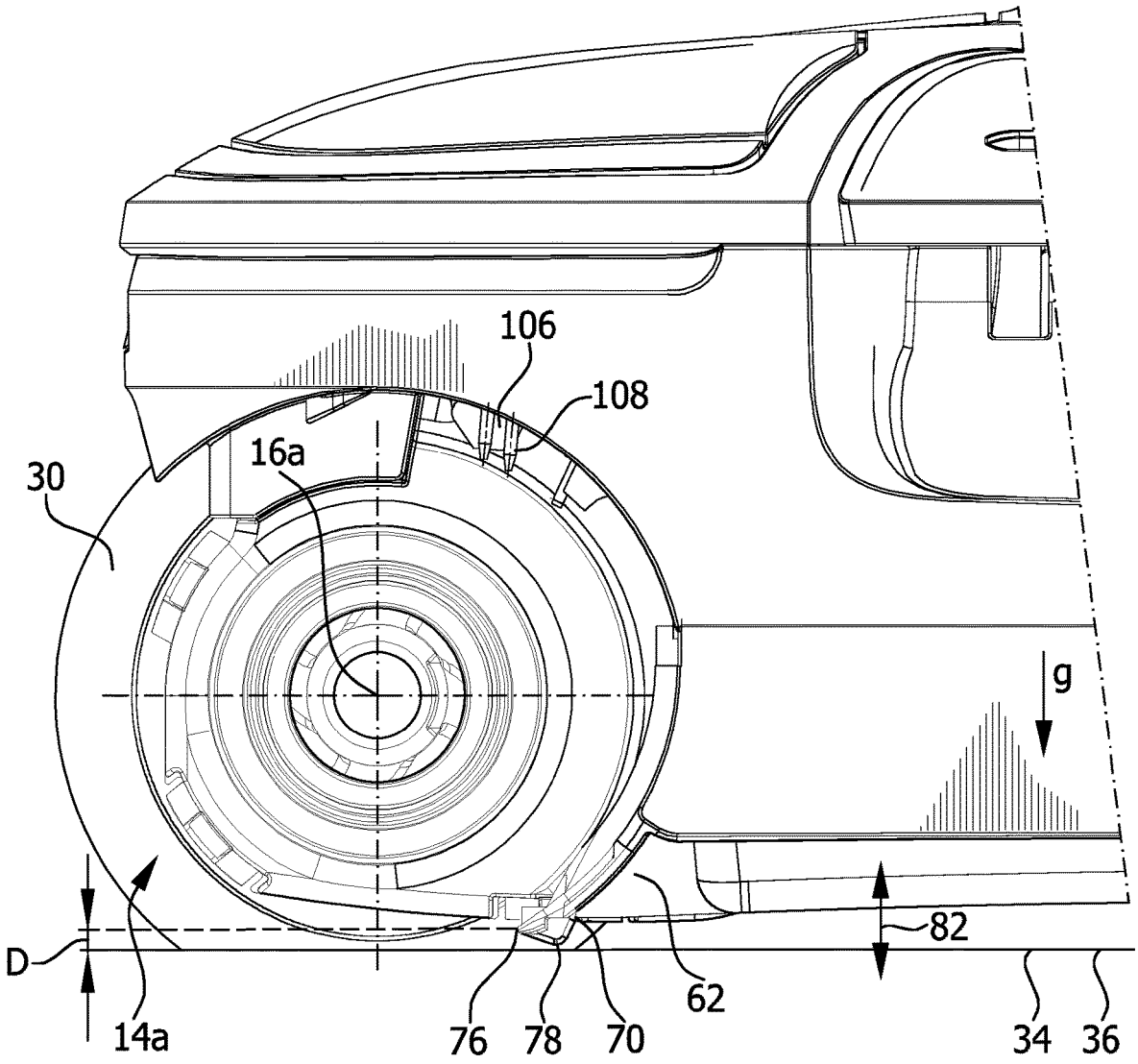
FIG. 4 shows the same view as FIG. 3, wherein the cleaning roller has been placed for a longer period of time and its diameter has decreased.

Provision is made that in the operation of the floor cleaning machine 10, the respective sweeping edge 76 of the first sweeping element 70 and the second sweeping element 72 are at a defined fixed distance D from the floor 34 to be cleaned (cf. FIGS. 3 and 4). This defined distance D is hereby independent of the diameter of the associated cleaning roller 14 and thus independent, for example, of wear to the textile covering 30. Further, it is independent of manufacturing tolerances.

The distance D is predetermined for an optimized cleaning result with respect to the coarse dirt gathering function of the sweeping element 70, 72. If the distance D is too small, the respective sweeping element 70 or 72 can get caught in joints, transitions, or the like on the floor 34 to be cleaned and this results in a more difficult operability. If the distance D is too large, this results in a worsened coarse dirt gathering function.

In particular, the distance D is greater than zero and preferably greater than 0.5 mm and preferably greater than 0.7 mm. Further, provision is made, in particular, that the defined distance D is smaller than 1.5 mm and, in particular, smaller than 1.3 mm.

In a preferred embodiment, the distance D is about 1 mm. In order to provide this defined distance D in a cleaning operation of the floor cleaning machine 10, support elements 78 are provided (FIGS. 3, 4) with which the first sweeping element 70 and the second sweeping element 72 are supported on the floor 34 to be cleaned. The support elements 78 are configured as sliding elements, which slide over the floor 34 in the cleaning operation of the floor cleaning machine 10.

The support elements 78 are configured precisely such that the sweeping edge 76 is at the distance D from the floor 34.

In one embodiment, the support elements 78 are formed by spaced apart ribs 80, which are arranged on the respective sweeping element 70, 72. Said ribs 80 extend beyond the sweeping edge 76 in the direction of the contact plane 36 to achieve the supporting function on the floor 34.

Between adjacent support elements 78 or ribs 80 is a free space over which the corresponding sweeping element 70, 72 does not contact the floor 34.

In particular, a row of support elements 78, in particular in the form of ribs, is provided on a respective sweeping element 70, 72. A corresponding row has a longitudinal direction, which is parallel to the corresponding axis of rotation 16*a*, 16*b* of the associated cleaning roller 14*a* and 14*b*, respectively.

Alternatively or in addition, it is possible that support elements 78 are arranged on the tank device 46 and thereby on the base 56 of the tray 52.

In the operation of the floor cleaning machine 10, the tank device 46 is supported on the floor 34 to be cleaned by way of the support elements 78. To keep the distance D independent of the specific situation of the cleaning roller 14, the tank device 46 or a partial region of the tank device (the tray 52) is floatingly mounted on the floor head 12 and thereby on the tank device holder 48. The tank device 46 has a movability in a z-direction 82 in relation to the partial region at which the sweeping elements 70, 72 are arranged. This z-direction 82 is hereby transverse and, in particular, perpendicular to the contact plane 36 of the cleaning rollers 14 on the floor 34.

Further, the z-direction 82 is oriented transversely and thereby, in particular, perpendicularly to the axes of rotation 16*a*, 16*b*.

Further, provision is preferably made that the z-direction 82 is oriented transversely and, in particular, perpendicularly to the pivot axis 42. As a result of the movability of the tray 52 with the sweeping elements 70, 72 in the z-direction 82 and as a result of the corresponding floating mounting on the floor head 12, the sweeping edge 76 is always at the fixed distance D from the floor 34, independently of the concrete diameter of the cleaning rollers 14. The movability of the tray 52 in the z-direction 82 results in an automatic setting of said fixed distance D of the sweeping edge 76 from the floor 34 during a cleaning operation. The support elements 78 ensure a "correct" positioning of the sweeping elements 70, 72 relative to the floor 34.

In one embodiment, the movability of the tank device 46 or the partial region on which the sweeping elements 70, 72

(of the tray 52) sit is achieved by a hanging mounting of the tray 52 on the floor head 12. In particular, the mounting is such that, for one, this fixed distance D can be set and, for another, the tray 52 does not fall off when the floor head 12 is lifted from the floor 34.

For example, corresponding counter fixing elements are associated with the fixing elements 68 on the tank device holder 48, which counter fixing elements enable the movability in the z-direction 28 and prevent the tray 52 from falling off. In particular, a releasing force and/or special release movement is required to be able to remove the tank device 46 from the floor head 12 in the removal direction 50.

In particular, the movability in the z-direction 82 is then also set such that precisely the compensation with respect to the fixed distance D made possible without the tank device 46 sitting "too loosely" on the floor head 12.

In one embodiment, for example, a respective web sits on adjacent fixing elements 68, said web then being positioned in a corresponding receptacle of the tank device holder 48 and being movable in the z-direction 82 when the tank device 46 is fixed to the floor head 12, wherein the movability is limited to a corresponding distance, and a release of the tank device 46 from the tank device holder 48 is blocked without additional measures.

Here, it is possible in principle that the tank device 46 as a whole with the lid 60 is movable relative to the floor head 12 in the z-direction or that, for example, the tray 52 is movable in the z-direction relative to a lid 60 or a lid formed by the tank device holder 48.

Provision may additionally be made that the tank device 46 or the partial region of the tank device 46 on which the sweeping elements 70, 72 sit is movable in at least one transverse direction 84*a*, 84*b* (cf. FIG. 5) relative to the z-direction 82 and is thereby floatingly mounted on the tank device holder 48.

The floor cleaning machine 10 comprises a tank device 86 for cleaning liquid (FIG. 1). Said tank device 86 for cleaning liquid accommodates a cleaning liquid, which is suppliable directly or indirectly to the floor 34 to be cleaned by way of a supply device 88.

The cleaning liquid is, in particular, fresh water to which a cleaning agent additive and, in particular, surfactant cleaning agent additive may be added. It is also possible in principle that the tank device 86 has separate tanks for fresh water and cleaning agent additive and a corresponding mixing takes place.

In one embodiment, cleaning liquid is supplied to the at least cleaning roller 14 by way of the supply device 88; the textile covering 30 of the corresponding cleaning roller 14 is then moistened by way of cleaning liquid.

Soiling on a floor 34 can be released by the cleaning liquid. In addition, a mechanical action on the dirt takes place by way of the corresponding cleaning roller 14. A rotational wiping movement of the cleaning roller 14 on the floor 34 takes place.

In one embodiment, the tank device 86 is arranged on the holding device 38. It is also possible in principle that it is arranged on the floor head 12.

In this case, reference is made, as an example, to WO 2017/15345 A1 or DE 10 2019 109 946.

Furthermore, reference is made to WO 2016//058901 A1. For example, in a cleaning operation of the floor cleaning machine 10 in which the cleaning rollers 14 are rotated, a supply of cleaning agent from the tank device 86 by way of the supply device 88 to the cleaning rollers 14 is automatically effected by a valve being opened accordingly or a pump being switched on accordingly.

Figure 8:
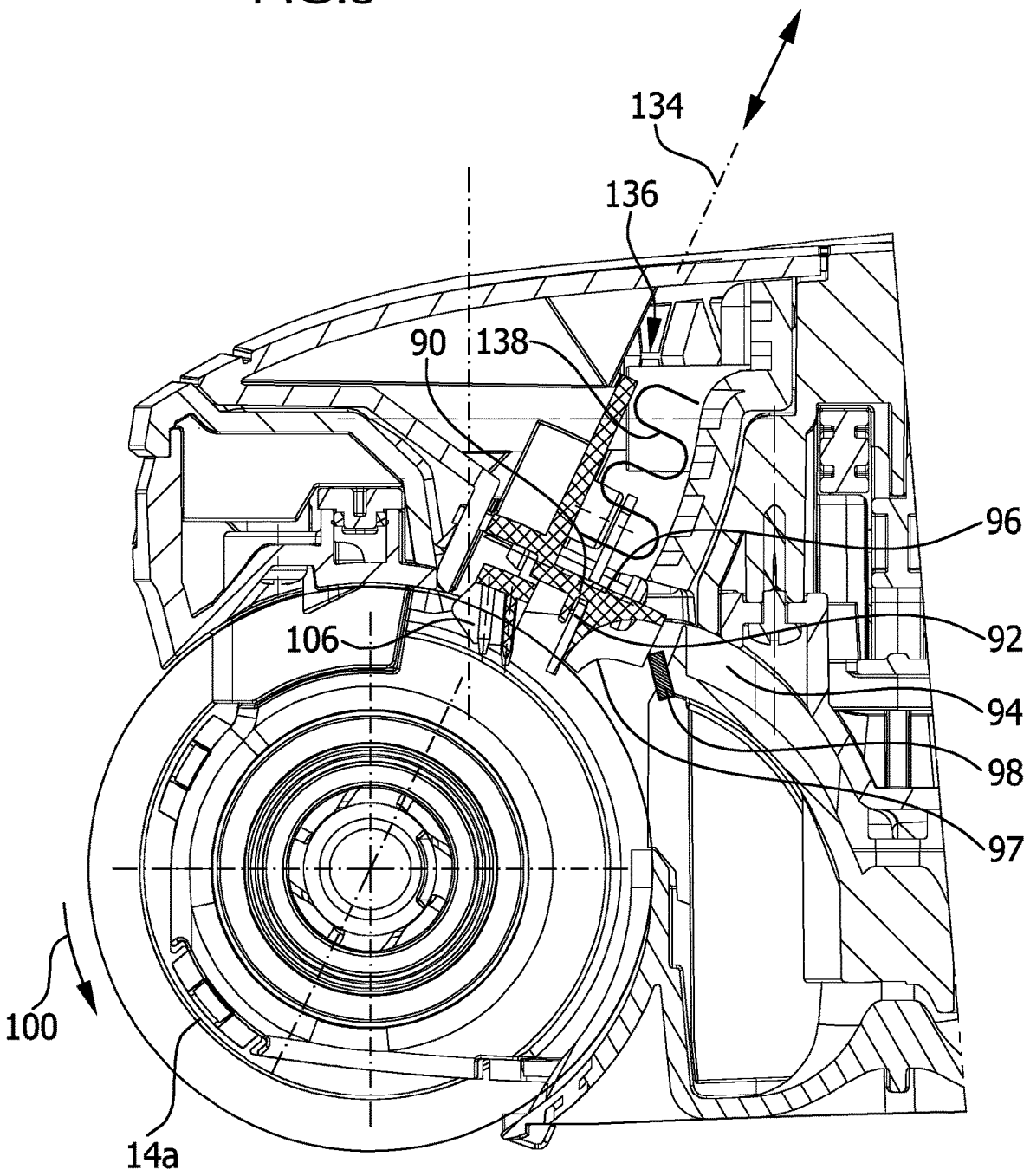
FIG. 8 shows a cut view of the floor cleaning machine according to FIG. 1 in the region of the front cleaning roller in a first position of a pin strip.

A respective scraping device 90 associated with the cleaning rollers 14 is arranged on the floor head 12 (cf. FIG. 8). The scraping device 90 comprises a scraper 92, which penetrates into the textile covering 30 of the associated cleaning roller 14*a*, 14*b*. By means of the corresponding scraper 92, dirty fluid can be removed from the associated cleaning roller 14 and conveyed into the tank device 46. Reference is made in this respect to WO 2019/086083 A1.

For this purpose, (at least) one feed channel 94 is provided, which opens into the receiving space 54.

In one embodiment, the scraper 92 is arranged on an input-coupling element 96. An opening 97 for the feed channel 94 is arranged on the input-coupling element 96. The scraper 92 forms an opening wall for the opening 97. In particular, the tank device 46 or the partial region on which the sweeping elements 70, 72 sit is movable in the z-direction 82 relative to the input-coupling element 96.

To enable this movability of the tank device 46 and to obtain a sealed supply channel 94, a sealing device 98 is provided, which seals the supply channel 94 from the input-coupling element 96 in order to obtain a fluid-tight supply channel 94 when the tank device 46 is at different positions in the z-direction relative to the input-coupling element 96. The scraper 92 is positioned at a distance from the respective sweeping element 70, 72.

In one embodiment, provision is made that the corresponding cleaning roller 14 rotates in such a direction of rotation 100 that the scraper 92 is arranged downstream from the corresponding sweeping element 70 or 72. Coarse dirt that is picked up by the corresponding sweeping element 70, 72 can thereby be transported by the corresponding cleaning roller 14 to the scraper 92. Dirty fluid is removed on the scraper 92 and conveyed into the receiving space 54 via the at least one feed channel 94.

It is possible, for example, that the input-coupling element 96 and/or the supply channel 94 are arranged on a lid 60 of the tank device 46. Reference is made in this respect to WO 2019/029821 A1.

It is then advantageous, in particular, if the tray 52 is movable relative to said lid 60 in order to enable the movability in the z-direction 82 to in turn be able to set the fixed distance D of the sweeping edges 76 from the floor 34.

With regard to the floatingly mounted tank device 46, the floor cleaning machine 10 functions as follows:

In a cleaning operation of the floor cleaning machine 10, it is placed on the floor 34 to be cleaned by way of the cleaning rollers 14*a*, 14*b* and is displaced over said floor 34.

The cleaning rollers 14*a*, 14*b* are applied with cleaning liquid from the tank device 86. The cleaning rollers 14*a*, 14*b* rotate in the direction of rotation 100 and, in particular, rotate in opposite directions.

The textile covering 30 is moistened. The cleaning rollers 14*a*, 14*b* act with a corresponding covering region on the floor 34 to be cleaned. A mechanical action takes place, and dirt is moistened in order to improve the detachment thereof.

Coarse dirt is gathered by way of the sweeping elements 70, 72 and can be entrained by the corresponding cleaning roller 14*a*, 14*b* in the direction of rotation 100.

Dirty fluid including coarse dirt can be removed from the cleaning roller 14 on the respective scraper and is then conveyed into the tank device 46 and thereby into the corresponding receiving space 54.

The sweeping elements 70, 72 are arranged on the tray 52 and thereby on the tank device 46 or on a partial region of the tank device 46. The tray 52 with the sweeping elements 70, 72 is swimmingly mounted on the floor head 12 in the z-direction 82. In the cleaning operation, the tray 52 is supported on the floor 34 to be cleaned by way of the support elements 78. The fixed defined distance D between the sweeping edge 76 and the floor 34 is thereby automatically set.

This automatic setting takes place in the case of the different covering thicknesses B of the corresponding cleaning roller 14*a*, 14*b* (cf. FIGS. 3 and 4). The covering thickness B can change, for example, in the case of corresponding wear to the cleaning roller 14, or may be different due to manufacturing tolerances.

For example, the textile covering 30 is also compressed to a greater extent at a placement region on the floor 34 to be cleaned than outside of said region (cf. FIGS. 3 and 4). When the tank device 46 is full, the width B may be smaller than when it is empty.

The floating mounting of the tank device 46 or of the tray 52 enables a movability of the tray 52 in relation to the axis of rotation 16*a* or 16*b* of the corresponding cleaning roller 14 in the z-direction 82. Compare the FIGS. 3 and 4 in which the tray 52 adopts different positions relative to the axis of rotation 16*a*.

This always results, as explained, in the fixed distance D of the sweeping edge 76 from the floor 34, independently of the situation on the cleaning roller 14. This in turn results in an optimized coarse dirt gathering function for the respective sweeping element 70, 72. Thus, on the one hand, it can be prevented that it catches on the floor 34 and, on the other hand, it is prevented that larger particles can "slip through" under the respective sweeping element 70, 72.

The corresponding function is independent of manufacturing tolerances and is ensured over the lifetime of the cleaning roller 14 with wear to the textile covering 30 (with a reduction of the diameter of the cleaning rollers 14).

In one embodiment, provision is made that the tank device 46 or the tray 52 is mounted on the floor head 12 such that it is pressed against the floor 34 in a gravity-driven manner so that the support elements 78 rest on the floor 34. The dead weight of the tray 52 effects the automatic positioning of the sweeping edge 76 at the fixed distance D from the floor 32. Alternatively or in addition, it is possible that a spring device 102 presses the tray 52 in a direction 104 toward the contact plane 36 (cf. FIG. 3). The spring device 102 is thereby supported, in particular, on the tank device holder 48 and on the tray 52 in order to correspondingly press the support elements 78 against the floor 34.

A pin strip 106 with a plurality of pins 108 is arranged on the floor head 12. The pins 108 of the pin strip 106 are pins that abut against the textile covering 30 or project into the textile covering 30 of the associated cleaning roller 14*a*, 14*b*.

The pin strip 106 serves to pick up hair in the manner of a hairbrush.

The pins 108 are, in particular, made of a plastic material.

The pin strip 106 is arranged on the floor head 12 such that it is removable as a whole by a user. The user can then clean the pin strip 106 with hair caught therein.

The pin strip 106 comprises a support 110 on which the pins 108 are arranged. The pins 108 thereby project beyond the support 110.

The pins 108 extend in a pin direction 114. They have a flat face side 116. In particular, a pin 108 on the face side 116 has a diameter in the range between 0.1 mm and 0.5 mm. In one embodiment, this diameter on the face side 116 is about 0.3 mm.

In one embodiment, the pin strip 106 is formed on an input-coupling element 118. The input-coupling element 118 is positioned on the floor head 12. The input-coupling element 118 is removable as a whole from the floor head 12, or the pin strip 106 is removable from the input-coupling element 118.

The input-coupling element 118 comprises a holder 120. The support 110 of the pin strip 106 with the pins 108 sits fixedly or releasably on the holder 120 (see above).

Further, the scraper 92 sits on the holder 120 of the input-coupling element 118 at a distance from the pins 108.

Further, in one embodiment, the opening 97 is at least partially formed on the input-coupling element 118.

Arranged on the support 110, which, in particular, sits fixedly on the holder 120, are a first row 122*a* and a second row 122*b* of pins 108.

Figure 11:
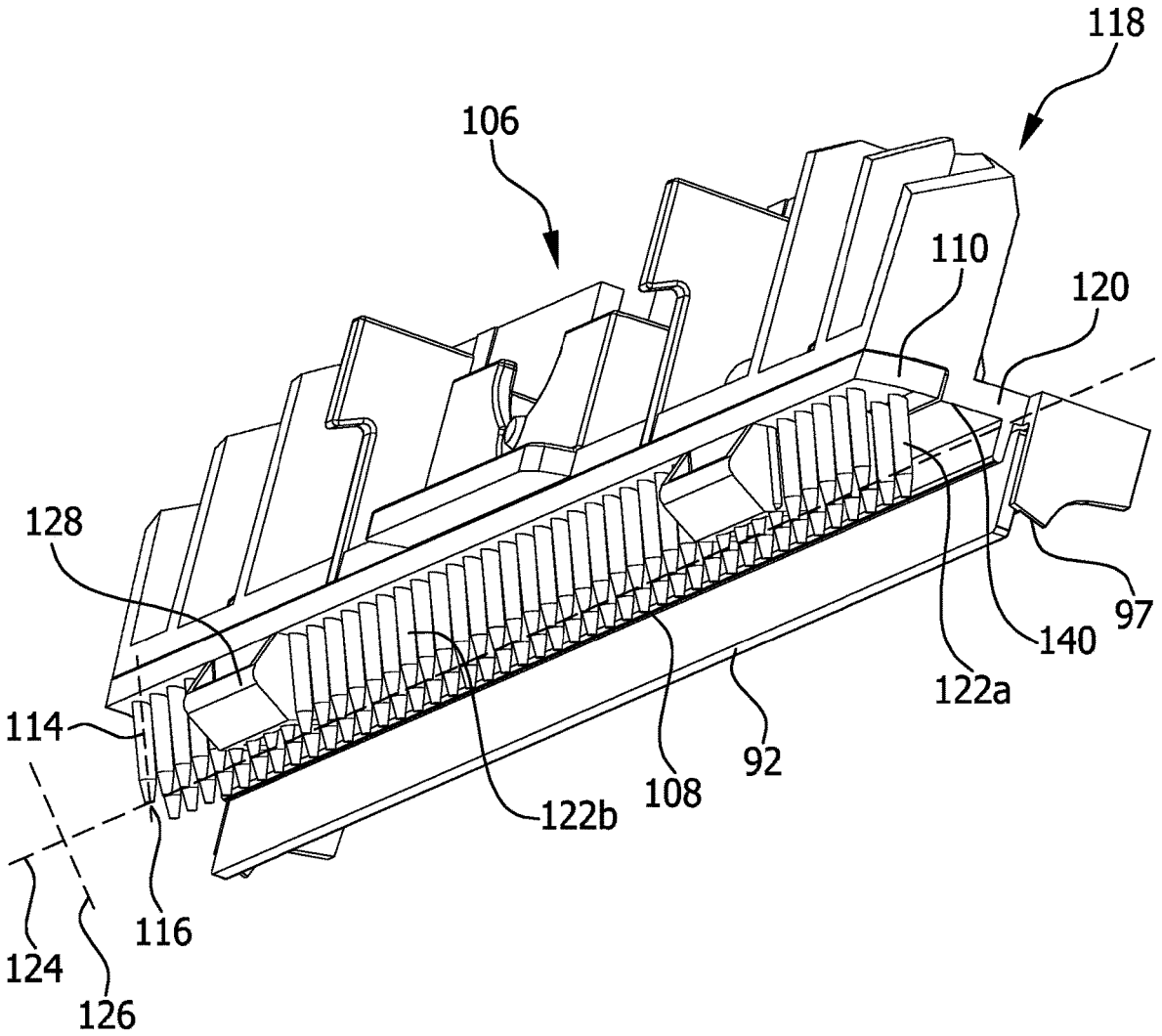
FIG. 11 shows a perspective depiction of an embodiment of a pin strip.
Figure 12:
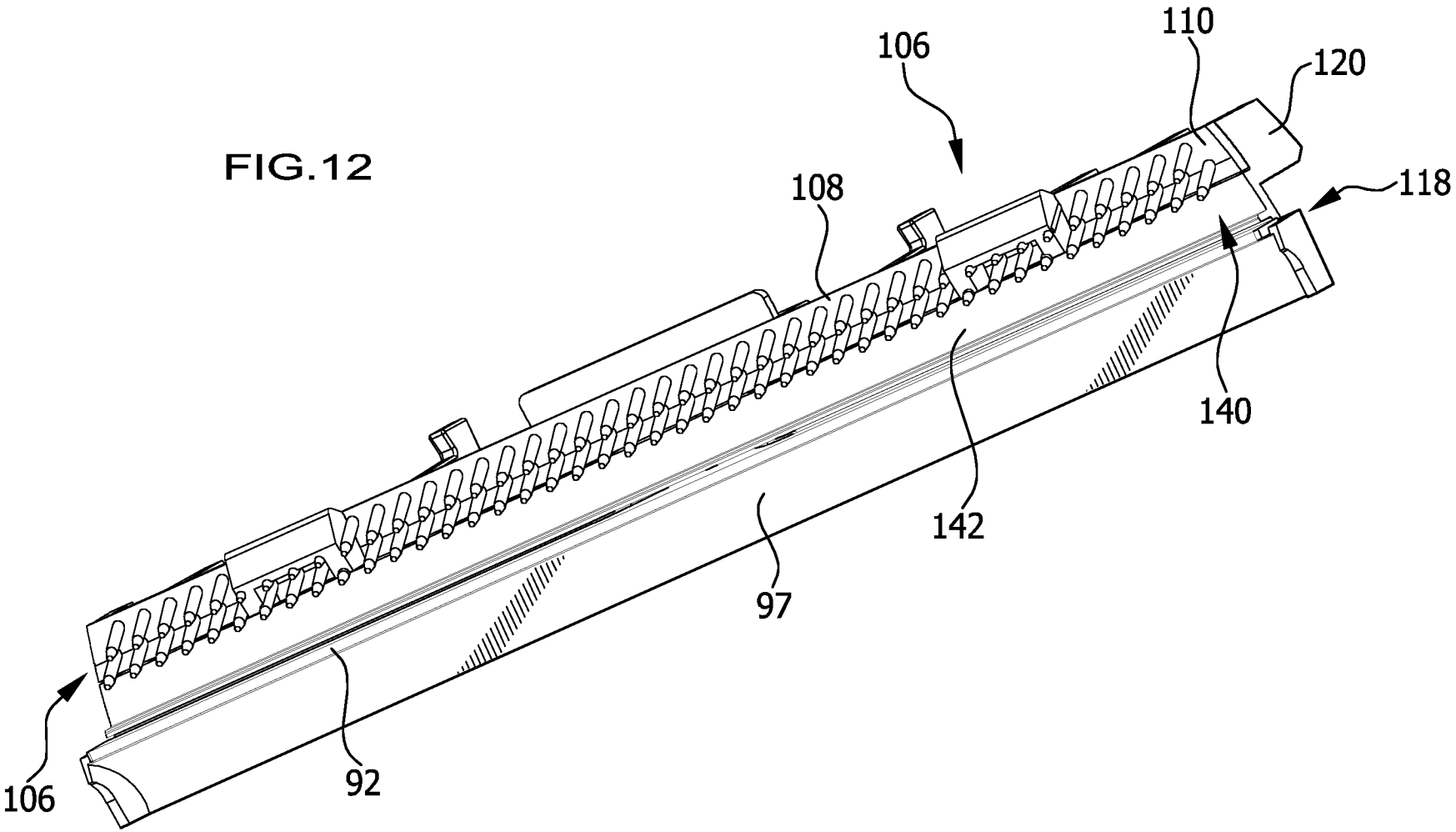
FIG. 12 shows a further perspective depiction of the pin strip according to FIG. 11.
Figure 13:
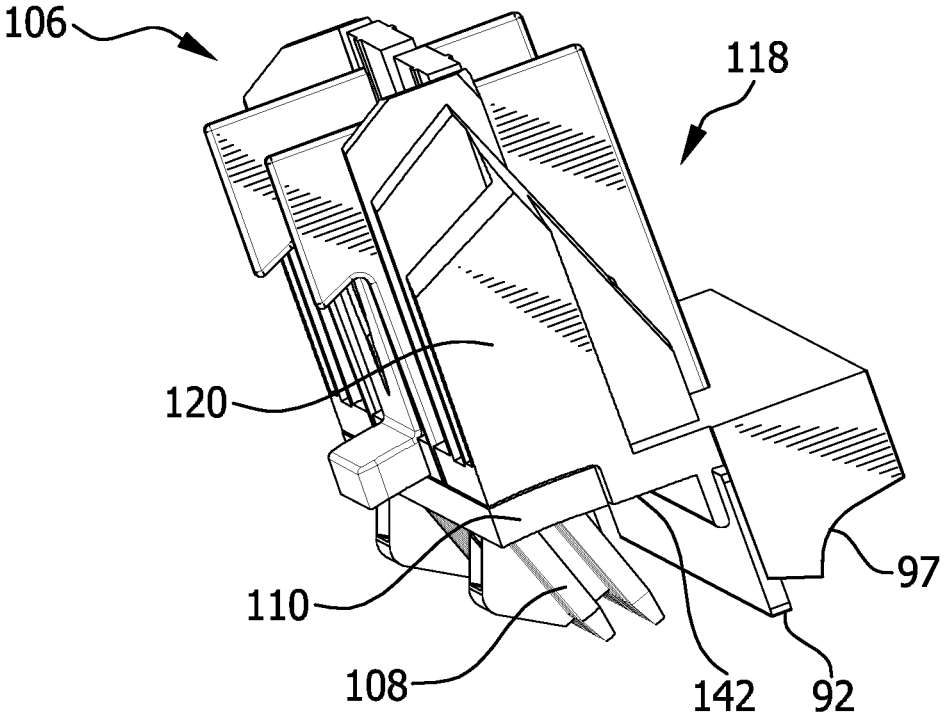
FIG. 13 shows a further perspective depiction of the pin strip according to FIG. 11.
Figure 14:
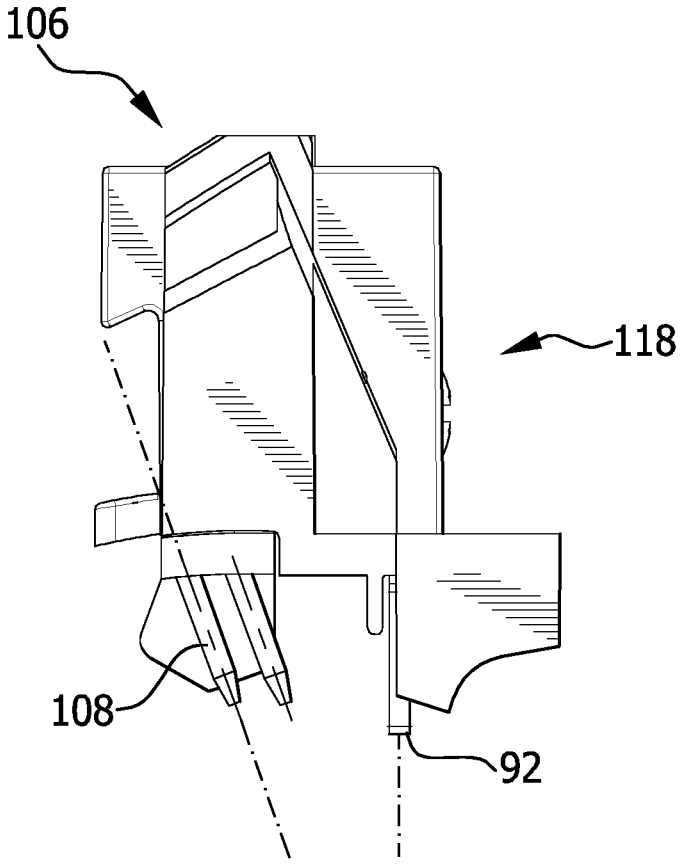
FIG. 14 shows a side view of the pin strip according to FIG. 11.
Figure 15:
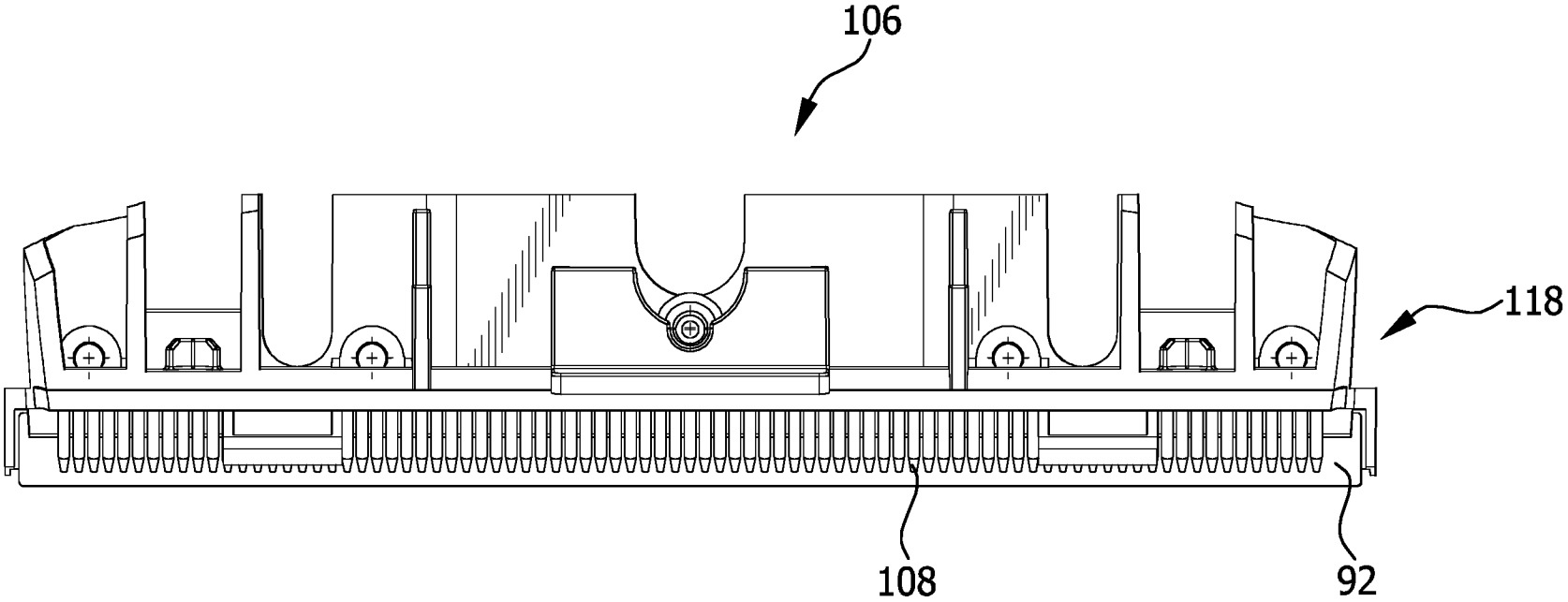
FIG. 15 shows a front view of the pin strip according to FIG. 11.

The first row 122*a* and the second row 122*b* extend in a longitudinal direction 124 (FIG. 11). In particular, the face sides 116 of the pins 108 in a row 122*a* or 122*b* are in a line parallel to the longitudinal direction 124.

When the pin strip 106 is positioned on the floor head 12, the longitudinal direction 124 is in parallel to the corresponding first axis of rotation 16*a* for the first cleaning roller 14*a* or to the second axis of rotation 16*b* for the second cleaning roller 14*b*.

Further, the longitudinal direction 124 is at least approximately parallel to the contact plane 36.

The second row 122*b* is spaced at a distance from the first row 122*a* in a transverse direction 126.

In the embodiment shown, the pins 108 in the first row 122*a* and in the second row 122*b* are each in a line.

It is possible in principle that pins are also offset in the transverse direction 126 within a row.

The rows 122*a*, 122*b* have, in particular, a length that corresponds substantially to a length of the associated cleaning roller 14*a*, 14*b* or is somewhat shorter. A pickup of hair is thereby ensured substantially over the entire length of the corresponding cleaning roller 14.

Coupling elements 128 and, in particular, latching elements, by way of which the pin strip 106 is connectable and, in particular, latchable to a corresponding counter element on the floor head 12, sit on the holder 120 and, in particular, on the support 110. The coupling elements 128 and their counter elements are configured such that a user can release and replace the pin strip 106 or the input coupling element 128 in a simple manner, in particular for cleaning purposes.

Figure 10:
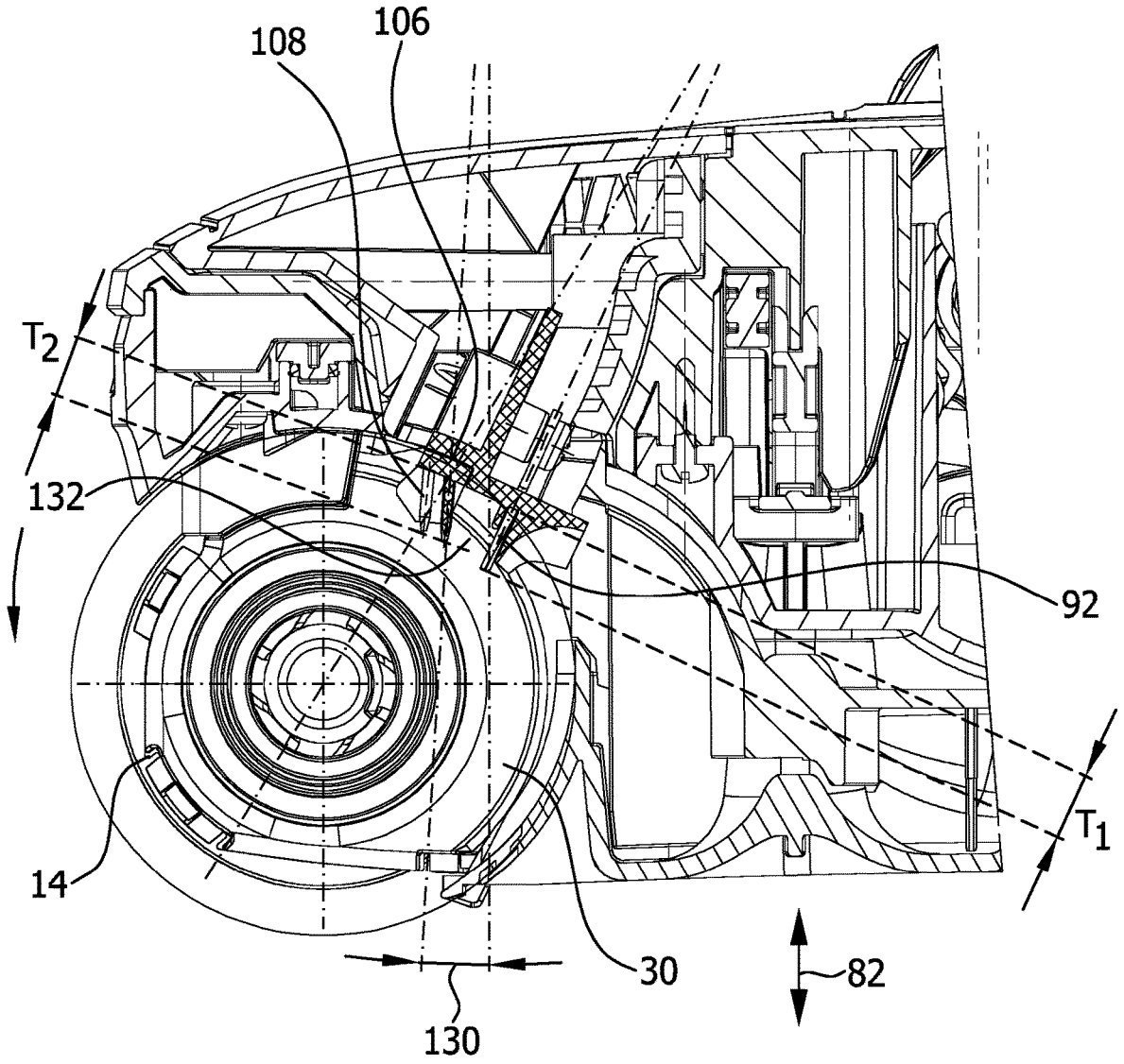
FIG. 10 shows the same view as FIG. 8 in a third position of the pin strip.

In the operation of the floor cleaning machine 10, the pins 108 of the pin strip 106 abut against or penetrate into the textile covering 30, cf. in particular FIG. 10.

In the operation of the floor cleaning machine 10, the scraper 92 penetrates into the textile covering 30 of the corresponding cleaning roller 14 with a depth $T_1$ (FIG. 10). A corresponding penetration depth of pins 108 is $T_2$.

The penetration depth $T_2$ is in the range between 0 mm and 4 mm inclusively, wherein a penetration depth of 0 mm means that the pins 108 abut with the face side 112 against the textile covering 30.

In particular, provision is made that the pins 108 project to an equal or lesser extent into the textile covering 30 than the scraper 92 (as an opening wall for scraping off dirty fluid and coupling into the tank device 46).

In particular, a difference $T_1$-$T_2$ is in the range between 0 mm and 1 mm inclusively.

Pins 108 and, in particular, all pins 108 are aligned in the pin direction 114 on the pin strip 106. This pin direction 140 is oriented transversely and, in particular, perpendicularly to the corresponding axis of rotation 16*a* or 16*b* of the associated cleaning roller 14.

The pin direction 140 is further oriented in parallel or obliquely to the z-direction 82. A corresponding angle 130 of the pin direction 114 to the z-direction 82 (and thus also to a normal of the contact plane 36) is, e.g., in the range between 0° and 10°.

Further, the pin direction 140 is in parallel or at an acute angle 132 to the scraper 92 (cf. FIG. 10). This angle 132 is, in particular, in the range between 0° and 25°.

It results in an optimized result for the pickup of hair if the pin direction 114 and the scraper 92 are not aligned in parallel to one another, but rather at an acute angle and, in particular, at an acute angle of about 20°.

The pins 108 on the pin strip 106 are arranged similarly to elements on a hairbrush in order to achieve an optimized pickup of hair. The pin strip 106 is arranged downstream from the scraper 92 in relation to the direction of rotation 100. Hair that was not coupled into the opening 97 can be picked up by the pin strip 106.

The pin strip 106 is resiliently mounted on the floor head 12. Alternatively or in addition, the scraper 92 with the opening 97 is mounted on the floor head 12 subjected to a force and, in particular, is mounted in a spring-loaded manner.

In the embodiment shown, the input-coupling element 118 is mounted on the floor head 12 subjected to a force and, in particular, is mounted in a spring-loaded manner. The pin strip 106 and the scraper 92 are thereby jointly mounted on the floor head 12 subjected to a force and, in particular, are mounted in a spring-loaded manner.

The input-coupling element 118 is mounted on the floor head 12 so as to be movable and, in particular, displaceable in a motion axis 134. The input-coupling element 118 sits on a displacement guide 136. The motion axis 134 is thereby oriented transversely and, in particular, perpendicularly to the respective axis of rotation 16*a* or 16*b*.

The motion axis 134 is, in particular, at an acute angle to the z-direction 82. Further, the motion axis 134 is at an acute angle to the normal of the contact plane 36. The motion axis 134 is, in particular, aligned to a central axis of the associated cleaning roller 14.

In one embodiment, the motion axis 134 is oriented in parallel to the scraper 92. A spring device 138 for applying a force is associated with the input-coupling element 118 (cf. FIG. 8). The spring device 138 exerts a spring force, which seeks to press the input-coupling element 118 with the pin strip 106 and the scraper 92 against the textile covering 30 of the associated cleaning roller 14.

In one embodiment, the input-coupling element 118 comprises an abutment element 140 with an abutment surface 142 as a contact surface for the textile covering 30. The abutment surface 142 may abut against the textile covering 30 or penetrate into it.

In particular, the pins 108 and the scraper 92 extend over the abutment surface 142. The abutment element 140 forms a stop for the input-coupling element 118 against the corresponding cleaning roller 14. It is configured such that the pins 108 and the scraper 92 each penetrate into the textile covering 30 with the desired penetration depth $T_2$ and $T_1$, respectively.

It is thus guaranteed that the corresponding (preset) penetration depth $T_1$ and penetration depth $T_2$ is achieved, independently of the diameter 30 of the corresponding cleaning roller 14.

The abutment element 140 is pressed against the surface of the cleaning roller 14 by the spring device 138, independently of the diameter of the cleaning roller 14.

Even if, for example, the diameter of the cleaning roller 14 is reduced due to wear to the textile covering 30, the depth $T_1$ and $T_2$ that is predetermined for an optimized cleaning result is maintained.

Corresponding manufacturing tolerances can also be compensated for by the displaceable mounting and spring mounting of the input-coupling element 118.

By means of the input-coupling element 118, a constant distance from the textile covering 30 is achieved, independently of the condition or the configuration of the corresponding cleaning roller 14. This results in an optimized scraping result both for dirty fluids and for hair.

The penetration depths $T_1$ and $T_2$ are independent of tolerances, roller diameters, and wear. An optimized dirt pickup (including hair pickup) can thus be ensured. For one, an insufficient penetration is prevented (which can have a negative effect on the dirt pickup) and, for another, an excessive penetration is prevented (which can can lead to increased current consumption by the floor cleaning machine 10 as well as an increased load on the motor and on the transmission).

The spring device 138 can be formed by one or more coil springs. The application of force can also be formed, e.g., by one or more rubber buffers. It is also possible that, for example, a pressure cylinder is provided for the application of force.

In principle, it is also possible that the abutment of the abutment element 140 against the textile covering 30 of the associated cleaning roller 14 is gravity-driven alone.

In the described embodiment, an input-coupling element 118 is provided, on which both the pin strip 106 and the scraper 92 are arranged.

It is possible in principle that separate movable and, in particular, displaceable elements are provided for the pin strip 106 and for the scraper 92.

It is further possible that either only the pin strip 106 is movably and, in particular, displaceably mounted, or only the scraper 92 is displaceably mounted.

Figure 9:
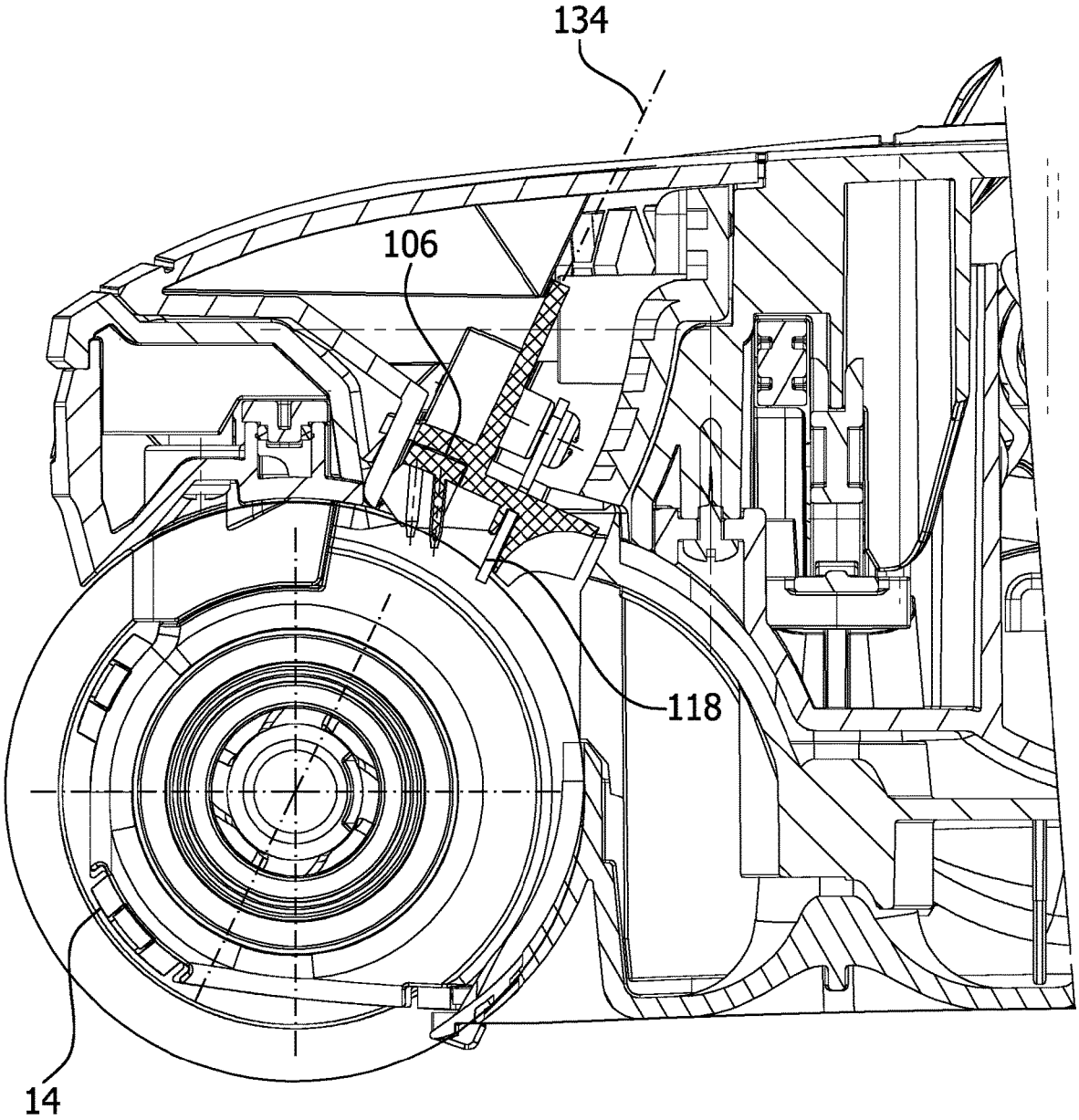
FIG. 9 shows the same view as FIG. 8 in a second position of the pin strip.

Shown in FIGS. 8 to 10 are respective different positions of the input-coupling element 118 on its displacement guide 136 relative to the first cleaning roller 14*a*.

The positions shown in FIGS. 8 and 9 are transition positions for explaining the basic functionality.

Shown in FIG. 10 is a final position in which the abutment surface 142 abuts against the textile covering 30 on the outside, such that the pins 108 and the scraper 92 each penetrate into the textile covering 30 with the respectively predetermined penetration depth $T_1$ and $T_2$.

As mentioned above, provision may also be made, for example, that the pins 108 only touch the textile covering 30 and do not penetrate into it (with a penetration depth $T_2$ of 0 mm).

The position shown in FIG. 9 is, in particular, also a position for the input-coupling element 118 when, for example, the cleaning roller 14 is to be exchanged.

Figure 16:
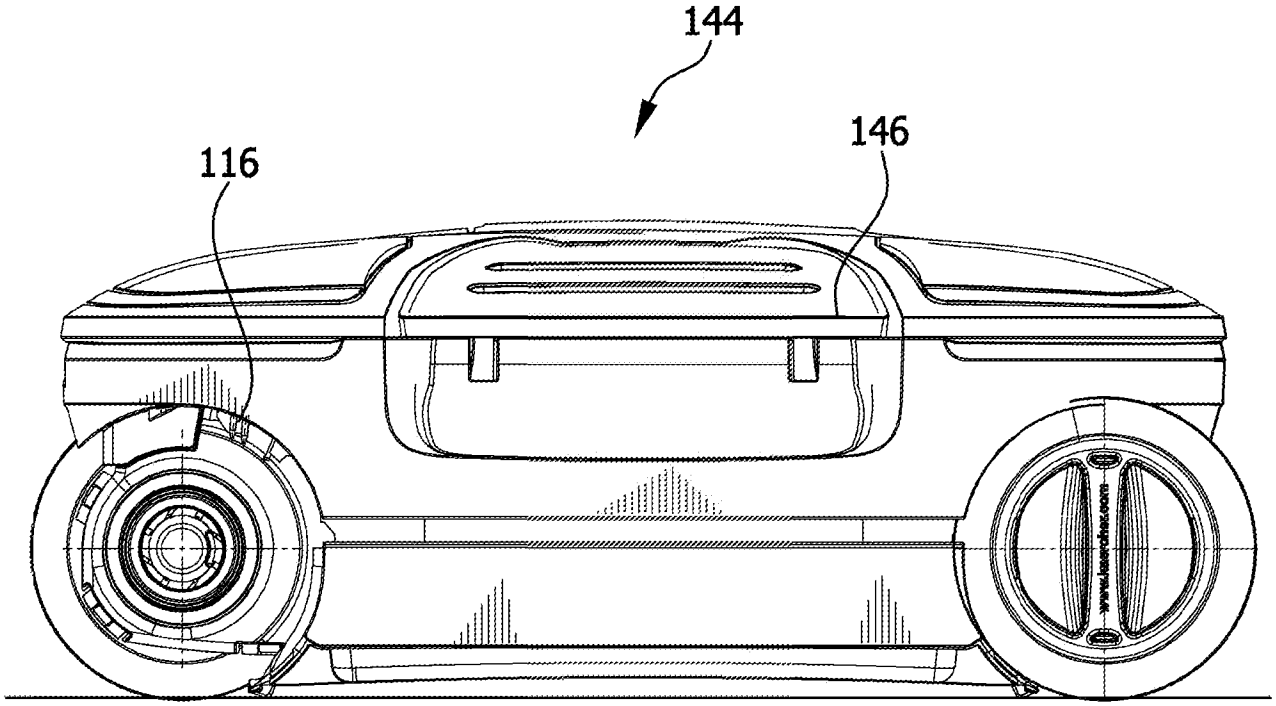
FIG. 16 shows a further embodiment of a floor cleaning machine in accordance with the invention (in the configuration as a self-propelled and self-steering floor cleaning machine)
Figure 17:
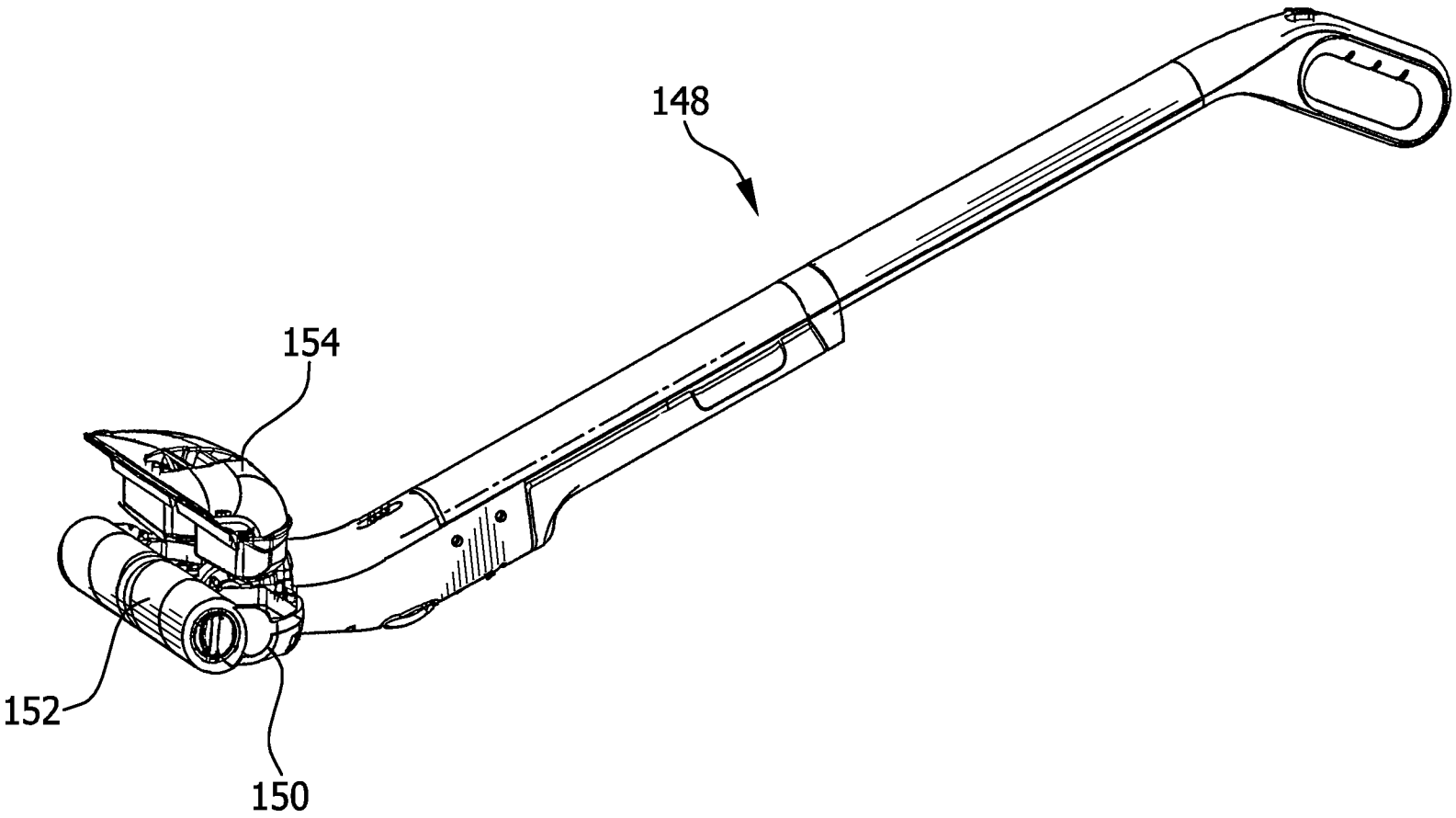
FIG. 17 shows a further embodiment of a hand-held and hand-guided floor cleaning machine.

It is possible that a floatingly mounted tank, as is described on the basis of the floor cleaning machine 10, is also used in the case of a floor cleaning machine 144 (FIG. 16), which is of self-propelled and, in particular, self-steering configuration. On such a floor cleaning machine, which has a floor head 146, in particular, a tank device for cleaning liquid is then also arranged on the floor head.

With respect to the floating mounting of the tank device for dirty liquid, on which one or more sweeping elements are arranged, the functioning is the same as described above. The floor cleaning machine 144 may also be equipped with one or more pin strips 106 for hair pickup.

Further, it is possible that a corresponding pin strip 106 and/or a scraper 92 for a corresponding cleaning roller 14 is movably and, in particular, displaceably mounted and, in particular, is mounted under the application of force. A further embodiment of a floor cleaning machine 148 (FIG. 16) comprises a floor head 150. The floor head 150 is supported on a floor to be cleaned by way of one single cleaning roller 152 in a cleaning operation. A removable tank device 154 for dirty fluid sits on the floor head 150.

The floor head 150 is provided with a pin strip corresponding to the pin strip 106, which, in particular, sits on the tank device 154.

In particular, provision is made that the pin strip 106 and/or a corresponding scraper for the cleaning roller 152 is movably and, in particular, displaceably mounted and, in particular, mounted in a spring-loaded manner, as described above.

REFERENCE NUMERAL LIST

10 floor cleaning machine
12 floor head
14*a* first cleaning roller
14*b* second cleaning roller
16*a* first axis of rotation
16*b* second axis of rotation
18 first shaft
20 first shaft region
22 second shaft region
24 first part
26 second part
28 side rim
30 textile covering
32 holder
34 floor
36 contact plane
38 holding device
40 pivot j oint
42 pivot axis
44 pivot axis
46 tank device
48 tank device holder
50 removal direction
52 tray
54 receiving space
56 base
58 wall
60 lid
62 side wall
64 side wall
66 recess
68 fixing element
70 first sweeping element
72 second sweeping element
74 recess
76 sweeping edge
78 support elements
80 ribs
82 z-direction
84*a*, 84*b* transverse direction
86 tank device for cleaning liquid
88 supply device
90 scraping device
92 scraper
94 feed channel
96 input-coupling element
97 opening
98 sealing device
100 direction of rotation
102 spring device
104 direction
106 pin strip
108 pin
110 support
112 face side
114 pin direction
116 face side
118 input-coupling element
120 holder
122*a* first row
122*b* second row
124 longitudinal direction
126 transverse direction
128 coupling element
130 shaft
132 shaft
134 motion axis
136 displacement guide
138 spring device
140 abutment element
142 abutment surface
144 floor cleaning machine
146 floor head
148 floor cleaning machine
150 floor head
152 cleaning roller
154 tank device
D distance from the floor 34
$T_1$, $T_2$ penetration depth

The invention claimed is:

1. A floor cleaning machine, comprising a floor head, and at least one cleaning roller, which is arranged on the floor head and rotates about an axis of rotation in a cleaning operation, wherein the at least one cleaning roller has a textile covering, and wherein on the floor head a holder is mounted and is movably mounted to the floor head and movable relative to the at least one cleaning roller, and with at least one of the following:

at least one pin strip with a plurality of pins is arranged on the holder, wherein the at least one pin strip is movable relative to the at least one cleaning roller via the movability of the holder on the floor head, and wherein the pins abut against or penetrate into the textile covering based on the movement of the holder with respect to the at least one cleaning roller;

at least one scraper of a scraping device is arranged on the holder, wherein the at least one scraper is movable relative to the at least one cleaning roller via the movability of the holder on the floor head, and wherein the at least one scraper penetrates into the textile covering, wherein a position of the pins and/or the scraper on the at least one cleaning roller is determined independently of the diameter of the at least one cleaning roller and based on the movable mounting of the holder on the floor head.

2. The floor cleaning machine in accordance with claim 1, wherein the pins penetrate into the textile covering with a penetration depth in the range between 0 mm and 4 mm.

3. The floor cleaning machine in accordance with claim 1, wherein the pins have a flat face side, which has a diameter in the range between 0.1 mm and 0.5 mm.

4. The floor cleaning machine in accordance with claim 1, wherein pins are arranged on the at least one pin strip in at least one row, wherein the at least one row has a longitudinal direction.

5. The floor cleaning machine in accordance with claim 4, wherein the longitudinal direction is at least approximately parallel to an axis of rotation of the at least one cleaning roller.

6. The floor cleaning machine in accordance with claim 4, wherein the at least one row comprises a plurality of rows, wherein the rows are spaced at a distance in a transverse direction and the transverse direction is oriented transversely to the longitudinal direction.

7. The floor cleaning machine in accordance with claim 1, wherein the at least one pin strip is positioned on the floor head so as to be releasable by a user.

8. The floor cleaning machine in accordance with claim 1, wherein the pins project into the textile covering to an equal or lesser extent than the at least one scraper and wherein a difference between a penetration depth of the scraper and a penetration depth of the pins is in the range between 0 mm and 1 mm.

9. The floor cleaning machine in accordance with claim 1, wherein the at least one pin strip is arranged downstream from the at least one scraper in relation to a direction of rotation of the at least one cleaning roller.

10. The floor cleaning machine in accordance with claim 1, wherein the pins are aligned in a pin direction, with at least one of the following:

the pins are of straight configuration;

the pin direction is oriented transversely and perpendicularly to the axis of rotation;

the pin direction is oriented in parallel or obliquely to a z-direction in which a tank device is movably mounted on the floor head in a cleaning operation;

the pin direction is oriented perpendicularly or obliquely to a contact plane of the at least one cleaning roller for the floor to be cleaned;

the pin direction is in an angular range between 0° and 25° to a motion axis of the at least one pin strip;

the pin direction is parallel or at an acute angle to at least one of a scraper and an opening wall for the at least one cleaning roller.

11. The floor cleaning machine in accordance with claim 1, wherein an input-coupling element for dirty liquid into a tank device is arranged on the holder or the holder is formed by the input-coupling element, with at least one of the following:

the at least one scraper is arranged on the input-coupling element;

at least one opening for coupling dirty fluid into a tank device is arranged completely or partially on the input-coupling element;

the at least one scraper forms an opening wall;

the at least one pin strip sits on the input-coupling element;

the at least one pin strip is removable from the input-coupling element for a user and/or the input-coupling element is removable from the floor head for a user.

12. The floor cleaning machine in accordance with claim 1, comprising a motion axis for the at least one pin strip or the holder with at least one of the following:

the motion axis is oriented transversely and perpendicularly to the axis of rotation;

the motion axis is oriented perpendicularly or obliquely to a contact plane of the at least one cleaning roller for a floor to be cleaned;

the motion axis is oriented in parallel or obliquely to a z-axis in which a tank device, which sits on the floor head, is movable;

the motion axis is aligned to the axis of rotation.

13. The floor cleaning machine in accordance with claim 1, comprising a movability of the at least one pin strip or the holder relative to a tank device, which is arranged on the floor head.

14. The floor cleaning machine in accordance with claim 1, wherein the at least one pin strip or the holder is force-driven in the direction of the at least one cleaning roller and is pressed against the at least one cleaning roller.

15. The floor cleaning machine in accordance with claim 1, wherein a spring device is provided for the at least one pin strip or the holder, or the at least one pin strip or the holder are gravity-driven.

16. The floor cleaning machine in accordance with claim 1, wherein at least one of the at least one pin strip and the holder have an abutment surface for the at least one cleaning roller.

17. The floor cleaning machine in accordance with claim 1, wherein the at least one cleaning roller is of two-part configuration and a center drive is provided.

18. The floor cleaning machine in accordance with claim 1, wherein a tank device for dirty liquid is arranged on the floor head and dirty liquid, which is removed from the at least one cleaning roller, is feedable to the tank device in a blower-free manner.

19. The floor cleaning machine in accordance with claim 1, comprising a tank device for cleaning liquid and a supply device for cleaning liquid to at least one of the at least one cleaning roller and a floor to be cleaned.

20. The floor cleaning machine in accordance claim 1, wherein a sweeping element is associated with the at least one cleaning roller, and wherein the at least one sweeping element is arranged upstream from a scraper for the at least one cleaning roller in relation to a normal direction of rotation of the at least one cleaning roller in a cleaning operation.

21. The floor cleaning machine in accordance with claim 1, comprising a first cleaning roller and a second cleaning roller, which is arranged on the floor head at a distance from the first cleaning roller, with at least one of the following:

a first axis of rotation of the first cleaning roller and a second axis of rotation of the second cleaning roller are oriented in parallel to one another;

in a normal operating mode of the floor cleaning machine, the first cleaning roller and the second cleaning roller rotate in opposite directions;

a tank device for dirty liquid is arranged on the floor head;

the tank device for dirty liquid is positioned between the first cleaning roller and the second cleaning roller;

a blower-free input-coupling of dirty liquid from the first cleaning roller and the second cleaning roller into the tank device is provided;

at least one of (i) a first sweeping element is associated with the first cleaning roller and (ii) a second sweeping element is associated with the second cleaning roller.

22. The floor cleaning machine in accordance with claim 1, wherein one single cleaning roller is arranged on the floor head.

23. The floor cleaning machine in accordance with claim 1, comprising a holding device for a user, which is arranged on the floor head, wherein the floor cleaning machine is of hand-held or hand-guided configuration, and wherein same is operable by a user in a standing position.

24. The floor cleaning machine in accordance with claim 1, having a self-propelled and self-steering configuration.

25. A floor cleaning machine, comprising a floor head, and at least one cleaning roller, which is arranged on the floor head and rotates about an axis of rotation in a cleaning operation, wherein the at least one cleaning roller has a textile covering, and wherein on the floor head a holder is mounted and is movably mounted to the floor head and movable relative to the at least one cleaning roller, and with at least one of the following:

at least one pin strip with a plurality of pins is arranged on the holder, wherein the at least one pin strip is movable relative to the at least one cleaning roller via the movability of the holder on the floor head, and wherein the pins abut against or penetrate into the textile covering based on the movement of the holder with respect to the at least one cleaning roller;

at least one scraper of a scraping device is arranged on the holder, wherein the at least one scraper is movable relative to the at least one cleaning roller via the movability of the holder on the floor head, wherein the at least one scraper penetrates into the textile covering, and wherein a motion axis of the holder is oriented substantially transversely to the axis of rotation of the cleaning roller.

26. A floor cleaning machine, comprising a floor head, and at least one cleaning roller, which is arranged on the floor head and rotates about an axis of rotation in a cleaning operation, wherein the at least one cleaning roller has a textile covering, and wherein on the floor head a holder is mounted and is movably mounted to the floor head and movable relative to the at least one cleaning roller, and with at least one of the following:

at least one pin strip with a plurality of pins is arranged on the holder, wherein the at least one pin strip is movable relative to the at least one cleaning roller via the movability of the holder on the floor head, and wherein the pins abut against or penetrate into the textile covering based on the movement of the holder with respect to the at least one cleaning roller;

at least one scraper of a scraping device is arranged on the holder, wherein the at least one scraper is movable relative to the at least one cleaning roller via the movability of the holder on the floor head, wherein the at least one scraper penetrates into the textile covering; and support elements formed as spaced apart ribs arranged on a sweeping element associated with the at least one cleaning roller, and wherein the at least one sweeping element is arranged upstream from a scraper for the at least one cleaning roller in relation to a normal direction of rotation of the at least one cleaning roller in a cleaning operation, the ribs extending beyond a sweeping edge of the sweeping element in a direction of a contact plane to achieve a supporting function on a floor.

* * * * *